US011620924B2

(12) United States Patent
Zhang

(10) Patent No.: US 11,620,924 B2
(45) Date of Patent: Apr. 4, 2023

(54) RETRACTABLE APPARATUS

(71) Applicant: Shanghai Tianma Micro-Electronics Co., Ltd., Shanghai (CN)

(72) Inventor: Kaikai Zhang, Shanghai (CN)

(73) Assignee: Shanghai Tianma Micro-Electronics Co., Ltd., Shanghai (CN)

( * ) Notice: Subject to any disclaimer, the term of this patent is extended or adjusted under 35 U.S.C. 154(b) by 77 days.

(21) Appl. No.: 17/374,145

(22) Filed: Jul. 13, 2021

(65) Prior Publication Data

US 2021/0343198 A1 Nov. 4, 2021

(30) Foreign Application Priority Data

Mar. 31, 2021 (CN) ..... 202110345464.6

(51) Int. Cl.
*G09F 9/30* (2006.01)
*G09F 9/37* (2006.01)

(52) U.S. Cl.
CPC ..... *G09F 9/37* (2013.01); *G09F 9/301* (2013.01)

(58) Field of Classification Search
CPC ..... G06F 1/1652; G06F 2203/04102; G09F 9/37; G09F 9/301; G09G 2380/02
See application file for complete search history.

(56) References Cited

U.S. PATENT DOCUMENTS 6,297,905 B1 * 10/2001 Takamoto ..... G03B 21/58 359/461
8,096,068 B2 * 1/2012 Van Rens ..... H04M 1/0268 40/515
8,184,369 B2 * 5/2012 Kuroi ..... G03B 21/58 359/461
8,199,471 B2 * 6/2012 Bemelmans ..... G09F 9/00 455/462
9,519,313 B2 * 12/2016 Kim ..... G06F 1/166
10,410,549 B1 * 9/2019 Kim ..... G09F 11/02
10,789,863 B2 * 9/2020 Song ..... H05K 1/189
10,827,046 B1 * 11/2020 Li ..... H04B 7/0814
11,229,128 B2 * 1/2022 Kim ..... H05K 5/0017
2008/0144265 A1 * 6/2008 Aoki ..... G06F 1/1641 361/679.04
2011/0132557 A1 * 6/2011 Kuroi ..... G03B 21/58 160/368.1
2012/0002357 A1 * 1/2012 Auld ..... G09F 15/0062 361/679.01

(Continued)

FOREIGN PATENT DOCUMENTS

CN 108064404 A 5/2018
CN 111833748 A 10/2020

OTHER PUBLICATIONS

First Chinese Office Action dated Nov. 2, 2022, issued in corresponding Chinese Application No. 202110345464.6 filed on Mar. 31, 2021, and its English translation thereof, 9 pages.

*Primary Examiner* — Joe H Cheng
(74) *Attorney, Agent, or Firm* — Christensen O'Connor Johnson Kindness PLLC

(57) ABSTRACT

A retractable apparatus is provided. The retractable apparatus includes a stretchable mechanism. The stretchable mechanism includes a plurality of connecting portions arranged in a first plane. Adjacent connecting portions of the plurality of connecting portions are connected to each other in a retractable manner. At least three connecting portions are non-collinearly arranged.

20 Claims, 15 Drawing Sheets

(56) References Cited

U.S. PATENT DOCUMENTS

| | | | | |
|---|---|---|---|---|
| 2012/0314400 | A1* | 12/2012 | Bohn | G09F 9/35 361/679.01 |
| 2013/0021762 | A1* | 1/2013 | van Dijk | H05K 5/0226 361/749 |
| 2014/0247544 | A1* | 9/2014 | Ryu | G09F 11/18 361/679.01 |
| 2016/0147327 | A1 | 5/2016 | Choi et al. | |
| 2018/0114471 | A1* | 4/2018 | Park | G06F 1/1652 |
| 2020/0022269 | A1* | 1/2020 | Liao | H05K 5/0226 |

* cited by examiner

RETRACTABLE APPARATUS

CROSS-REFERENCE TO RELATED APPLICATIONS

The present application claims priority to Chinese Patent Application No. 202110345464.6, filed on Mar. 31, 2021, the content of which is incorporated herein by reference in its entirety.

TECHNICAL FIELD

The present disclosure relates to the technical field of display, and in particular, to a retractable apparatus.

BACKGROUND

An organic light-emitting diode (OLED) has a characteristic of self-illumination. Compared with a liquid crystal display technology, an OLED display has the advantages of being lighter and thinner, having higher brightness, having lower power consumption, having a faster response, having better flexibility, and having higher luminous efficiency, and can meet new requirements of consumers for a display technology. The development of OLED technologies has promoted the research of flexible, rolling, and foldable electronic devices. Flexible electronic skin already exists, and screens capable of tensile deformation are being developed. A retractable screen has a certain elasticity, and can withstand a certain amount of deformation under a tension and be restored to its original state when the tension is removed. The retractable screen itself can stretch and contract in all directions around it.

SUMMARY

An embodiment of the present disclosure provides a retractable apparatus, and the retractable apparatus includes a stretchable mechanism. The stretchable mechanism includes a plurality of connecting portions arranged in a first plane. Adjacent connecting portions of the plurality of connecting portions are connected to each other in a retractable manner, and at least three connecting portions of the plurality of connecting portions are non-collinearly arranged.

BRIEF DESCRIPTION OF DRAWINGS

In order to more clearly illustrate technical solutions in the embodiments of the present disclosure or in the related art, the accompanying drawings used in the embodiments are briefly introduced as follows. The drawings described as follows are some of the embodiments of the present disclosure, and other drawings can also be acquired by those skilled in the art without paying creative efforts.

DESCRIPTION OF EMBODIMENTS

In order to make the objectives, technical solutions, and advantages of the embodiments of the present disclosure clearer, the following clearly and completely describes the technical solutions in the embodiments of the present disclosure with reference to the accompanying drawings in the embodiments of the present disclosure. Apparently, the described embodiments are merely some rather than all of the embodiments of the present disclosure. All other embodiments that can be obtained by those of ordinary in the art based on the embodiments in the present disclosure shall fall within the protection scope of the present disclosure.

Terms used in the embodiments of the present disclosure are intended only to describe specific embodiments, rather than limiting the present disclosure. Singular forms "a/an", "said" and "the" used in the embodiments and appended claims of the present disclosure are also intended to include plural forms, unless other meanings are clearly indicated in the context.

In the related art, although foldable or rolling display apparatuses can realize stretching only in one direction, there is no solution in the industry to how to support the telescopic screen to take advantage of its characteristic of stretching in all directions. Based on the problems in the related art, an embodiment of the present disclosure provides a retractable apparatus. A stretchable mechanism of the retractable apparatus can stretch and contract in at least two directions that are not parallel to each other, that is, the two directions are non-linear directions. The stretchable mechanism can support a stretchable display panel and assist the stretchable display panel in stretching or contracting in at least two non-linear directions. Taking a rectangular stretchable display panel as an example, bidirectional stretching of the stretchable display panel can be realized.

Figure 1:
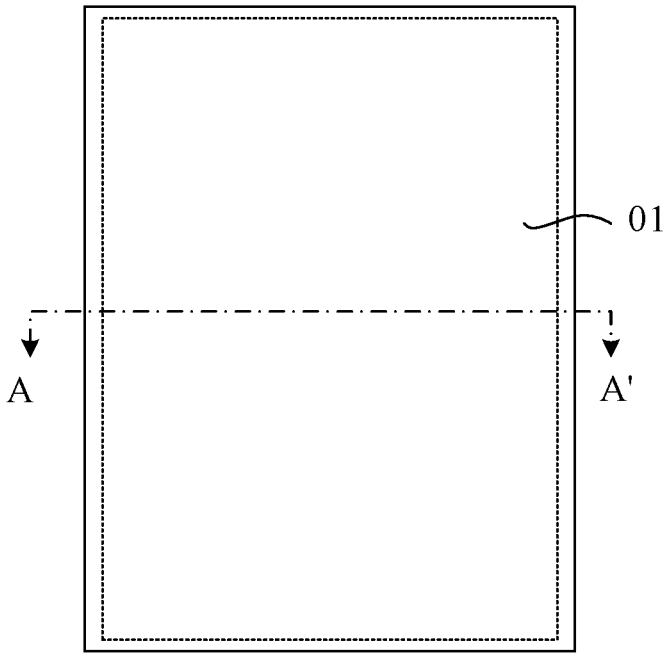
FIG. 1 is a schematic diagram of a retractable apparatus according to an embodiment of the present disclosure.
Figure 2:
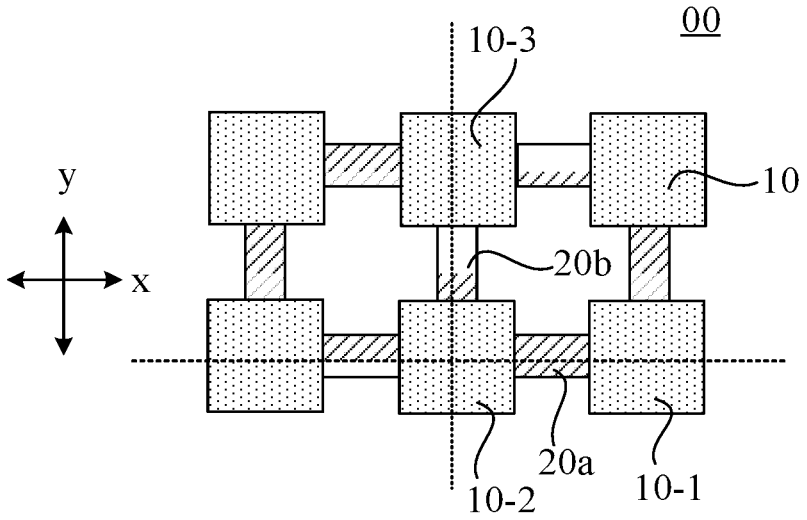
FIG. 2 is a partial simplified schematic diagram of a stretchable mechanism of a retractable apparatus according to an embodiment of the present disclosure.
Figure 3:
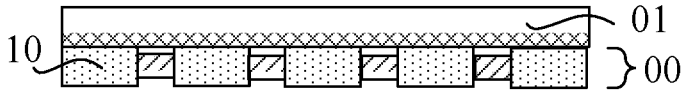
FIG. 3 is a schematic cross-sectional view along a tangent line A-A' in FIG. 1 according to an embodiment of the present disclosure.
Figure 4:
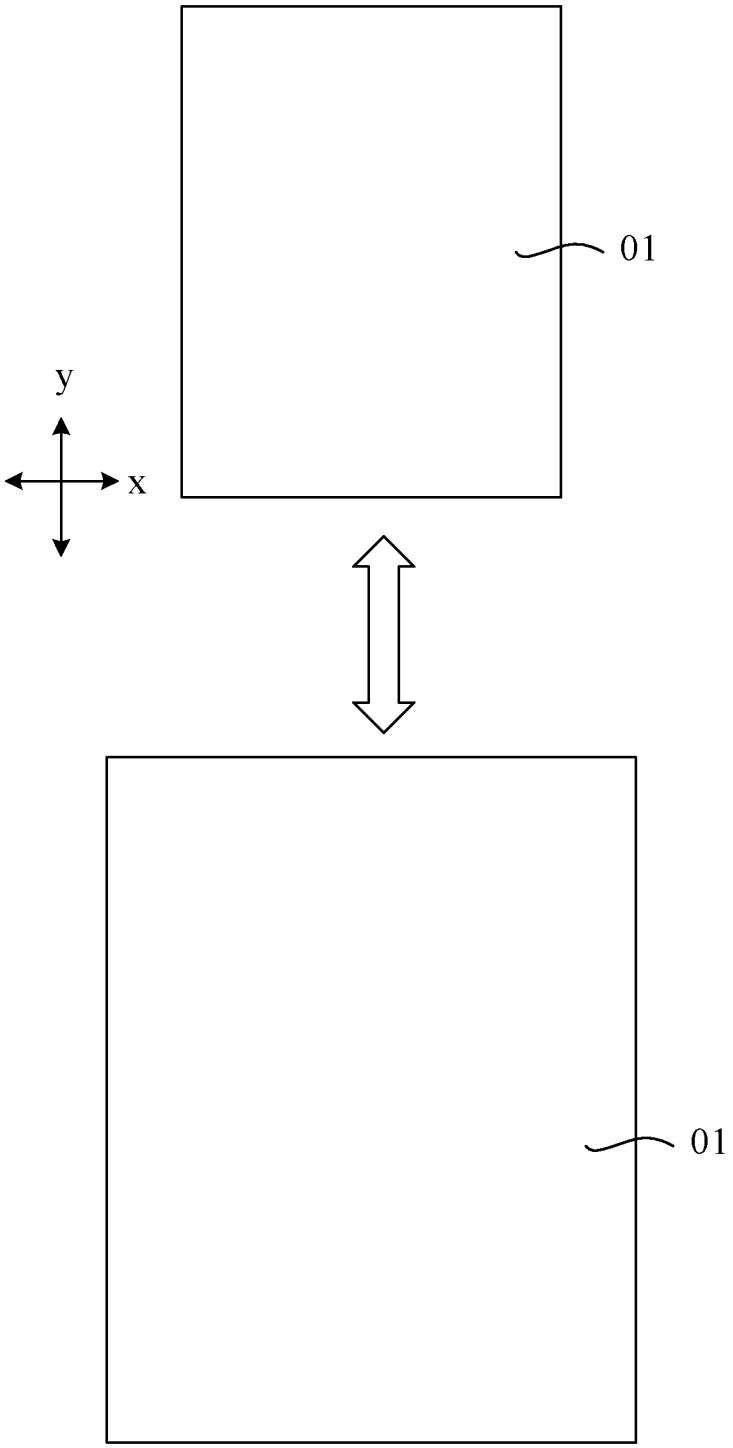
FIG. 4 is a schematic diagram showing a retractable state of the retractable apparatus illustrated in FIG. 1 according to an embodiment of the present disclosure.

FIG. 1 is a schematic diagram of a retractable apparatus according to an embodiment of the present disclosure, FIG. 2 is a partial simplified schematic diagram of a stretchable mechanism of a retractable apparatus according to an embodiment of the present disclosure, FIG. 3 is a schematic cross-sectional view along a tangent line A-A' shown in FIG. 1, and FIG. 4 is a schematic diagram showing a retractable state of the retractable apparatus illustrated in FIG. 1.

The structure of the retractable apparatus is understood with reference to FIG. 1 to FIG. 3. The retractable apparatus provided in the embodiment of the present disclosure includes a stretchable mechanism 00 and a stretchable display panel 01.

As shown in FIG. 2, the stretchable mechanism 00 includes a plurality of connecting portions 10 arranged in a first plane. That is, the plurality of connecting portions 10 is arranged in one plane. FIG. 2 is a partial schematic top view, in which a plane of the paper is located is the first plane. Adjacent connecting portions 10 are connected to each other in a retractable manner. At least three connecting portions 10 are non-collinearly arranged. "Non-collinearly arranged" is construed as not being arranged in the same direction. The figure illustrates a first direction x and a second direction y that intersect in the first plane. A first connecting portion 10-1 and a second connecting portion 10-2 are arranged along the first direction x, the second connecting portion 10-2 and a third connecting portion 10-3 are arranged along the second direction y, and thus the first connecting portion 10-1, the second connecting portion 10-2, and the third connecting portion 10-3 are non-collinearly arranged. In FIG. 2, the connecting portions 10 of the stretchable mechanism 00 and a connection manner between the connecting portions 10 are only simplified. It is to be noted that, in the embodiment of the present disclosure, the first connecting portion 10-1, the second connecting portion 10-2, and the third connecting portion 10-3 are not names of the connecting portions at specific positions in the stretchable mechanism 00. The naming and the location of the three connecting portions are only used to indicate the non-collinear arrangement of the three connecting portions.

As shown in FIG. 3, the stretchable mechanism 00 supports the stretchable display panel 01. The stretchable display panel 01 is located at a side of the first plane of the plurality of connecting portions 10. A side of the stretchable display panel 01 away from the plurality of connecting portions 10 can display images.

Adjacent connecting portions 10 of the stretchable mechanism 00 are connected to each other in a retractable manner. The "being connected to each other in a retractable manner" defined in the embodiment of the present disclosure indicates that two structures are connected to each other and the two structures can stretch and contract relative to each other in a particular direction. That is, an overall length of the two connected structures and the connecting members therebetween in a particular direction can increase with stretching between the connected structures and decrease with contraction between the connected structures.

Adjacent connecting portions 10 are connected to each other in a retractable manner, so that stretching and contraction between the adjacent connecting portions 10 arranged along the first direction x can realize stretching and contraction of the stretchable mechanism 00 in the first direction x. Correspondingly, the stretching and contraction between the adjacent connecting portions 10 arranged along the first direction x can realize stretching and contraction of the stretchable mechanism 00 in the second direction y. The stretchable mechanism in the present disclosure can realize stretching in at least two non-collinear directions or contraction in at least two non-collinear directions. In applications, the stretchable mechanism can support a stretchable display panel and assist the stretchable display panel in stretching in all directions.

The shape of the retractable apparatus shown in FIG. 1 is rectangular. The shape of the retractable apparatus is designed to match the shape of the stretchable display panel, which can ensure that the display screen occupies a relatively large proportion. The shape of the stretchable display panel is rectangular in the embodiment of FIG. 1. FIG. 4 illustrates a contraction state and a stretching state of the retractable apparatus provided in the embodiment of FIG. 1. As shown in FIG. 4, for the rectangular stretchable display panel, the stretchable mechanism can assist the stretchable display panel 01 in stretching in both a long-side direction (the second direction y in the figure) and a short-side direction (the first direction x in the figure), and can also assist the stretchable display panel 01 in contracting in both the long-side direction and the short-side direction.

In the retractable apparatus provided in the embodiment of the present disclosure, the stretchable display panel can also be circular, oval or in other shapes. The present disclosure does not specify the shape of the stretchable display panel. For the circular stretchable display panel, the stretchable mechanism can assist the stretchable display panel in stretching or contracting in all directions thereof, which is no longer illustrated in the figure.

In one application scenario, the stretchable mechanism 00 drives the stretchable display panel 01 to stretch in all directions thereof. After stretching, an area in the plane where the stretchable display panel 01 is located increases, and an area of a display region thereof is correspondingly stretched and increased. For the rectangular stretchable display panel 01, the stretching in both the long-side direction and the short-side direction, that is, bidirectional stretching, can avoid the distortion of a display screen caused by a change in an aspect ratio after the stretching of the display panel. The stretchable display panel in other shapes can also be understood with reference to the above. In an application scenario of stretching, it can be ensured that a ratio of the display screen changes little before and after stretching, so as to improve user experience.

In an embodiment, the retractable apparatus includes a controller. The controller can send a control instruction to control stretching of the stretchable display panel 01. For a rectangular retractable apparatus, stretching of the stretchable display panel 01 in both its long-side direction and its short-side direction are controlled by a same control instruction.

For the rectangular retractable apparatus, in another embodiment, the controller can send two control instructions to control the stretching of the stretchable display panel 01. One of the two instructions is configured to control the stretching of the stretchable display panel 01 in its long-side direction, and the other one of the two instructions is configured to control the stretching of the stretchable display panel 01 in its short-side direction. That is, a retractable state of the stretchable display panel in the long-side direction and a retractable state in the short-side direction can be independently controlled.

Figure 5:
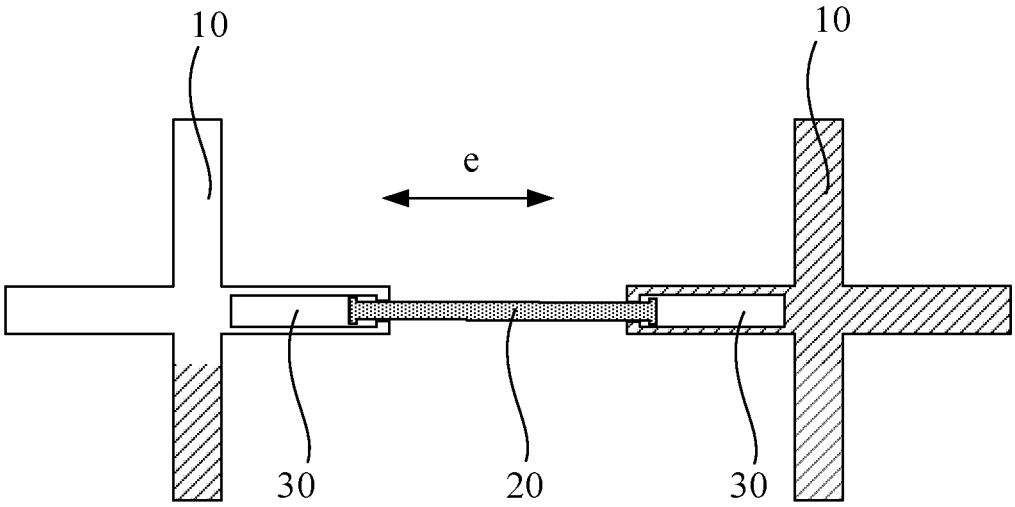
FIG. 5 is a partial schematic diagram of a stretchable mechanism according to an embodiment of the present disclosure.

In an embodiment, the retractable apparatus further includes connecting rods. The connecting portions are telescopically connected through the connecting rods. FIG. 5 is a partial schematic diagram of a stretchable mechanism according to an embodiment of the present disclosure. FIG. 5 is intended to illustrate only an example embodiment of a retractable connection between two adjacent connecting portions 10. The shape of the connecting portions 10 in FIG. 5 is only exemplary. Some embodiments of the connecting portions 10 are illustrated exemplarily.

As shown in FIG. 5, the two adjacent connecting portions 10 are connected to each other in a retractable manner through a connecting rod 20. The connecting portion 10 includes at least one chute 30, and one end of the connecting rod 20 is located in the one of the at least one chute 30 and is slidable along an extension direction of the chute 30. The extension direction of the chute 30 is a retractable direction between the connecting rod 20 and the connecting portion 10 that are connected to each other. The direction e shown in the figure is a retractable direction between the two adjacent connecting portions 10. Two ends of the connecting rod 20 respectively slide in the two chutes 30 of the two adjacent connecting portions 10 to realize relative movement between the two adjacent connecting portions 10, so as to realize stretching and contraction between the adjacent connecting portions 10. By setting that at least three connecting portions 10 are non-collinearly connected in the first plane, the stretchable mechanism can stretch or contract in at least two non-collinear directions, so as to support the stretchable display panel.

The connecting portions shown in the embodiment in FIG. 5 each include at least one chute. One end of the connecting portion is located in one of the at least one chute, and the retractable connection between two adjacent connecting portions is achieved through sliding connection between the connecting rod and the connecting portion. In another embodiment, for the connecting rod and the connecting portion that are connected to each other, the connecting rod includes at least one chute, the connecting portion include a sliding portion located in the chute and slidable along an extension direction of the chute. The connection between the connecting rod and the connecting portion can be understood with reference to FIG. 5.

In an embodiment, still referring to FIG. 2, the connecting rods includes a first connecting rod 20*a*, and the first connecting portion 10-1 and the second connecting portion 10-2 are retractable connected to each other in a first direction x through the first connecting rod 20*a*. The first direction x is located in the first plane. That is, an extension direction of the first connecting rod 20*a* is the first direction x, and the connecting portions 10 arranged in the first direction x are connected to each other in a retractable manner through the first connecting rod 20*a*, so that stretching and contracting functions of the stretchable mechanism in the first direction x can be realized, and then the stretchable mechanism carries and assists the stretchable display panel in stretching and contracting in the first direction x.

In an embodiment, as shown in FIG. 2, the connecting rod includes a second connecting rod 20*b*, and the third connecting portion 10-3 and the second connecting portion 10-2 are retractably connected in a second direction y through the second connecting rod 20*b*. The second direction y and the first direction x intersect, and the second direction y is located in the first plane. That is, an extension direction of the second connecting rod 20*b* is the second direction y, and the connecting portions 10 arranged in the second direction y are connected to each other in a retractable manner through the second connecting rod 20*b*, so that stretching and contracting functions of the stretchable mechanism in the second direction y can be realized, and then the stretchable mechanism carries and assists the stretchable display panel in stretching in both the second direction y and the first direction x or contracting in both the second direction y and the first direction x.

In some embodiments, for one second connecting portion, a retractable state between the second connecting portion and the third connecting portion is not linked to a retractable state between the second connecting portion and the first connecting portion.

Figure 6:
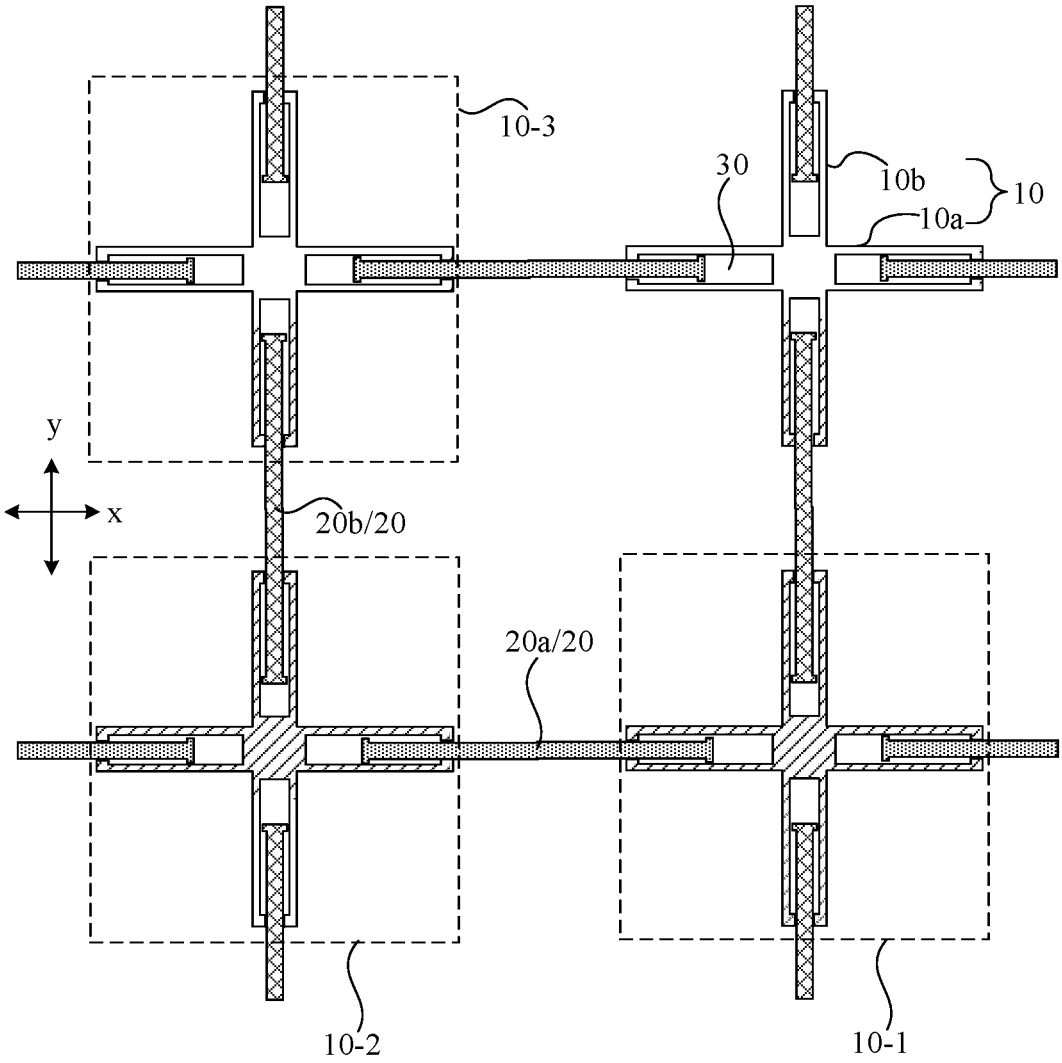
FIG. 6 is a partial schematic diagram of a stretchable mechanism of a retractable apparatus according to another embodiment of the present disclosure.

FIG. 6 is a partial schematic diagram of a stretchable mechanism in a retractable apparatus according to an embodiment of the present disclosure. In an embodiment, as shown in FIG. 6, the connecting portion 10 includes a first extension portion 10*a* extending in the first direction x and a second extension portion 10*b* extending in the second direction y, and the first extension portion 10*a* and the second extension portion 10*b* intersect. As illustrated, chutes 30 are respectively disposed on two ends of the first extension portion 10*a*, chutes 30 are respectively disposed on two ends of the second extension portion 10*b*, and one end of the connecting rod 20 is located in the chute 30 to realize a retractable connection between the connecting rod 20 and the connecting portion 10. The first connecting portion 10-1 and the second connecting portion 10-2 are connected to each other in a retractable manner in the first direction x through the first connecting rod 20*a*, and the second connecting portion 10-2 and the third connecting portion 10-3 are connected to each other in a retractable manner in the second direction y through the second connecting rod 20*b*. In this embodiment, the first connecting rod 20*a* and the second connecting rod 20*b* that connected to the second connecting portion 10-2 are not correlated through other movable structures. For one second connecting portion 10-2, its retractable state with the first connecting portion 10-1 and its retractable state with the third connecting portion 10-3 can be independent from each other. That is, a retractable state of the stretchable mechanism 00 in the first direction x can be independent from a retractable state in the second direction y. According to the retractable apparatus provided in this embodiment, in one application scenario, the stretchable mechanism 00 stretches or contracts in both the first direction x and the second direction y, so as to assist the stretchable display panel 01 to realize bidirectional stretching. In another application scenario, the stretchable mechanism 00 stretches in the first direction x or in the second direction y, or contracts in the first direction x or in the second direction y, so as to assist the stretchable display panel 01 to realize unidirectional stretching.

In some embodiments, an extension direction of the first connecting rod 20*a* is different from that an extension direction of the second connecting rod 20*b*; and for one second connecting portion 10-2, a retractable state between the second connecting portion 10-2 and the third connecting portion 10-3 is linked to a retractable state between the second connecting portion 10-2 and the first connecting portion 10-1. That is, the retractable state of the stretchable mechanism 00 in the first direction x is correlated with the retractable state of the stretchable mechanism 00 in the second direction y. By controlling the retractable state of the stretchable mechanism 00 in the first direction x, the retractable state thereof in the second direction y can be controlled at the same time. In an application where the stretchable display panel 10 can be bidirectionally stretched or contract, the retractable state of the stretchable mechanism 00 in the first direction x and the retractable state of the stretchable mechanism 00 in the second direction y do not need to be controlled respectively, which can simplify a control manner.

Figure 7:
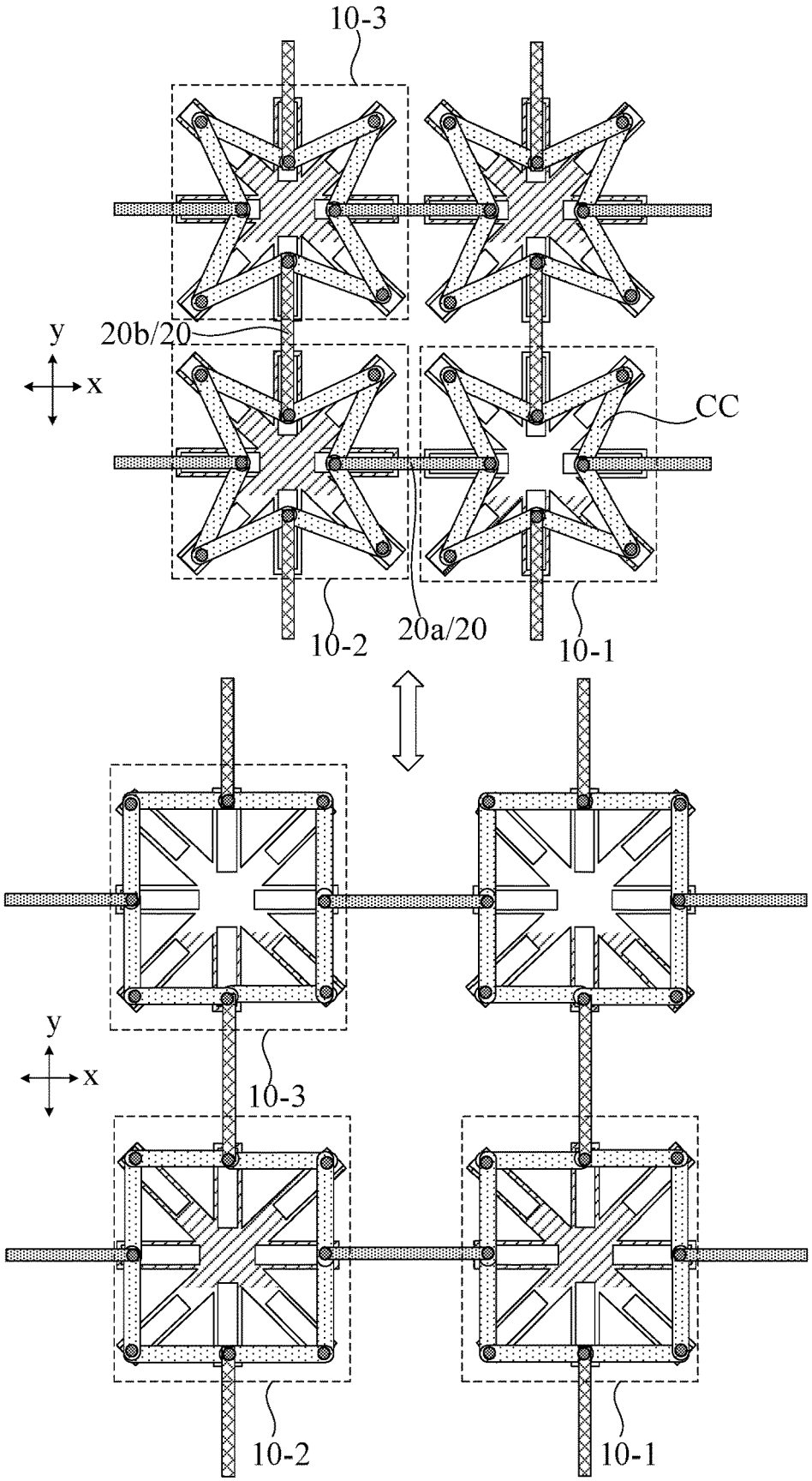
FIG. 7 is a partial schematic diagram of a stretchable mechanism of a retractable apparatus according to another embodiment of the present disclosure.

FIG. 7 is a partial schematic diagram of a stretchable mechanism of a retractable apparatus according to an embodiment of the present disclosure. In an embodiment, as shown in FIG. 7, the first connecting portion 10-1 and the second connecting portion 10-2 are connected in a retractable manner in the first direction x through the first connecting rod 20*a*, and the second connecting portion 10-2 and the third connecting portion 10-3 are connected in a retractable manner in the second direction y through the second connecting rod 20*b*. For one second connecting portion 10-2, stretching between the second connecting portion 10-2 and the second connecting rod 20*b* drives stretching between the second connecting portion 10-2 and the first connecting rod 20*a*; and/or contraction between the second connecting portion 10-2 and the second connecting rod 20*b* drives contraction between the second connecting portion 10-2 and the first connecting rod 20*a*. As illustrated in FIG. 7, the second connecting rod 20*b* is connected to the first connecting rod 20*a* through a transmission structure CC of the connecting portion. The transmission structure CC makes motion states of the two components connected through the transmission structure CC correlated. That is, the second connecting rod 20, when moving, can drive the first connecting rod 20*a* to move through the transmission structure CC. The transmission structure CC illustrated in FIG. 7 includes eight transmission rods. A transmission manner of the transmission structure CC will be described in the following specific embodiments.

Taking a stretching state as an example, the second connecting rod 20*b*, when moving away from a center of the second connecting portion 10-2 (which can be understood as a geometric center of the connecting portion in the first plane), can drive the first connecting rod 20*a* to move away from the center of the second connecting portion 10-2. Correspondingly, the second connecting rod 20*b*, when moving toward the center of the second connecting portion 10-2, can drive the first connecting rod 20*a* to move toward the center of the second connecting portion 10-2. The connecting portions arranged in the second direction y are connected through the second connecting rod 20*b*, and the connecting portions arranged in the first direction x are connected through the first connecting rod 20*a*, so that the stretchable mechanism 00 can stretch in both the first direction x and the second direction y, or the stretchable mechanism 00 can contract in both the first direction x and the second direction y, and thus the stretchable mechanism 00 can carry and assist the stretchable display panel 01 to stretch or contract in all directions thereof.

A specific structure of the connecting portion is also designed in the embodiment of the present disclosure, so as to correlate the retractable state of the stretchable mechanism in the first direction with the retractable state in the second direction. The following embodiments illustrate the structure of the connecting portion and a retractable movement between the connecting portion and the connecting rod.

In an embodiment, the connecting portion includes at least one transmission rod pair, the transmission rod pair includes two transmission rods extending in different directions and hinged to each other, a first ends of the two transmission rods are rotationally connected to each other, and a second ends of the two transmission rods are respectively connected to one first connecting rod and one second connecting rod. The transmission rod pair serves as a transmission structure between the first connecting rod and the second connecting rod. When the second connecting rod drives one transmission rod of the transmission rod pair connected to the second connecting rod to move, since the two transmission rods of the transmission rod pair are connected to each other, the other transmission rod can also drive the first connecting rod connected to the other transmission rod to move, so as to correlate the retractable state between the connecting portion and the second connecting rod with the retractable state between the connecting portion and the first connecting rod.

In an embodiment, the connecting portion further includes a rotationally connecting member, and the rotationally connecting member is configured to achieve mutual rotation between structures with respect to an axial direction perpendicular to the first plane. In an embodiment, the rotationally connecting member includes a rotating shaft through which two transmission rods of one transmission rod pair are hinged to each other. The two transmission rods connected through the rotating shaft can realize relative rotation in the first plane. An axial direction of the rotating shaft is perpendicular to the first plane.

Figure 8:
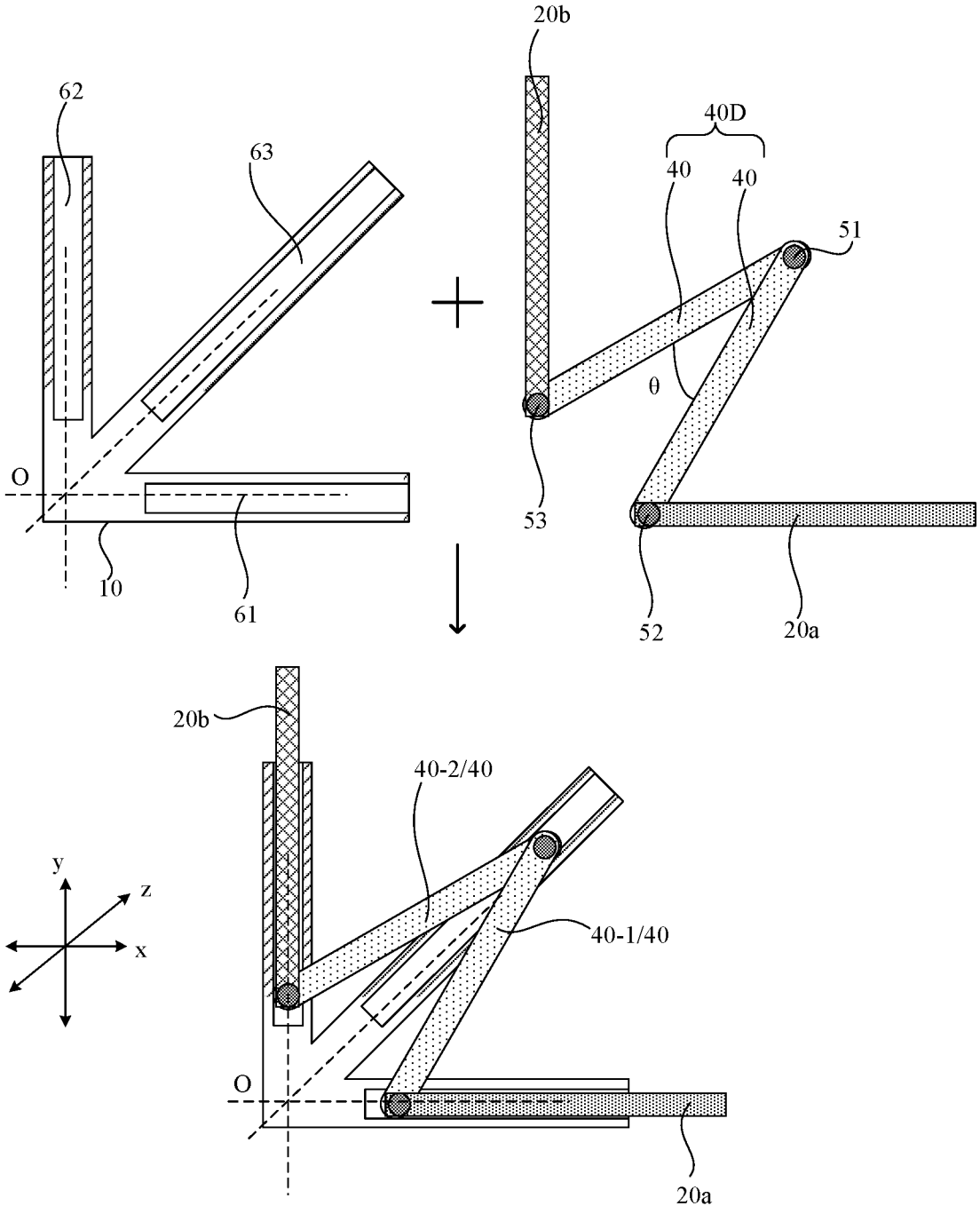
FIG. 8 is a schematic diagram of a connecting portion of a retractable apparatus according to another embodiment of the present disclosure.

FIG. 8 is a schematic diagram of connecting portions of a retractable apparatus according to an embodiment of the present disclosure. In an embodiment, as shown in FIG. 8, the transmission rod pair 40D in the connecting portion 10 includes two transmission rods 40. The transmission rods 40 each include a first end and a second end. For one transmission rod pair 40D, the first ends of the two transmission rods 40 are rotationally connected to each other through the first rotationally connecting member 51, and the second ends of the two transmission rods 40 are respectively connected to the different connecting rods. As illustrated in FIG. 8, the second end of one transmission rod 40 is connected to one first connecting rod 20*a*, and the second end of the other transmission rod 40 is connected to one second connecting rod 20*b*. An extension direction of the first connecting rod 20*a* is the first direction x, and an extension direction of the second connecting rod 20*a* is the second direction y. The transmission rod pair 40D serves as a transmission structure between the first connecting rod 20*a* and the second connecting rod 20*b* to correlate the retractable state between the connecting portion and the second connecting rod 20*b* with the retractable state between the connecting portion and the first connecting rod 20*a*.

In an embodiment, still referring to FIG. 8, the connecting portion 10 includes at least one chute, and the at least one chute includes at least one first chute 61, at least one second chute 62, and at least one third chute 63. The rotationally connecting member further includes a second rotationally connecting member 52 and the third rotationally connecting member 53. For one transmission rod pair 40D, the first rotationally connecting member 51 is limited in the third chute 63 and drives the first ends of the two transmission rods 40 to slide along the third chute 63; the second end of one transmission rod 40 is connected to the first connecting rod 20*a* through the second rotationally connecting member 52 limited in the first chute 61 and drives the second end of the transmission rod 40 to slide along the first chute 61; and the second end of the other transmission rod 40 is connected to the second connecting rod 20*b* through the third rotationally connecting member 53, and the rotationally connecting member 53 is limited in the second chute 62 and drives the second end of the other transmission rod 40 to slide along the second chute 62. The rotational connection between the transmission rods and the rotational connection between the transmission rod and the connecting rod are realized through the rotationally connecting members, and two structures connected by the rotationally connecting member can rotate relative to each other in the first plane. In this embodiment, the rotationally connecting member is limited in the corresponding chute, and the chute is such designed that linkage between the first connecting rod and the second connecting rod that are connected to the same connecting portion can be realized, and then the retractable state of the stretchable mechanism in the first direction can be correlated with the retractable state thereof in the second direction.

Figure 9:
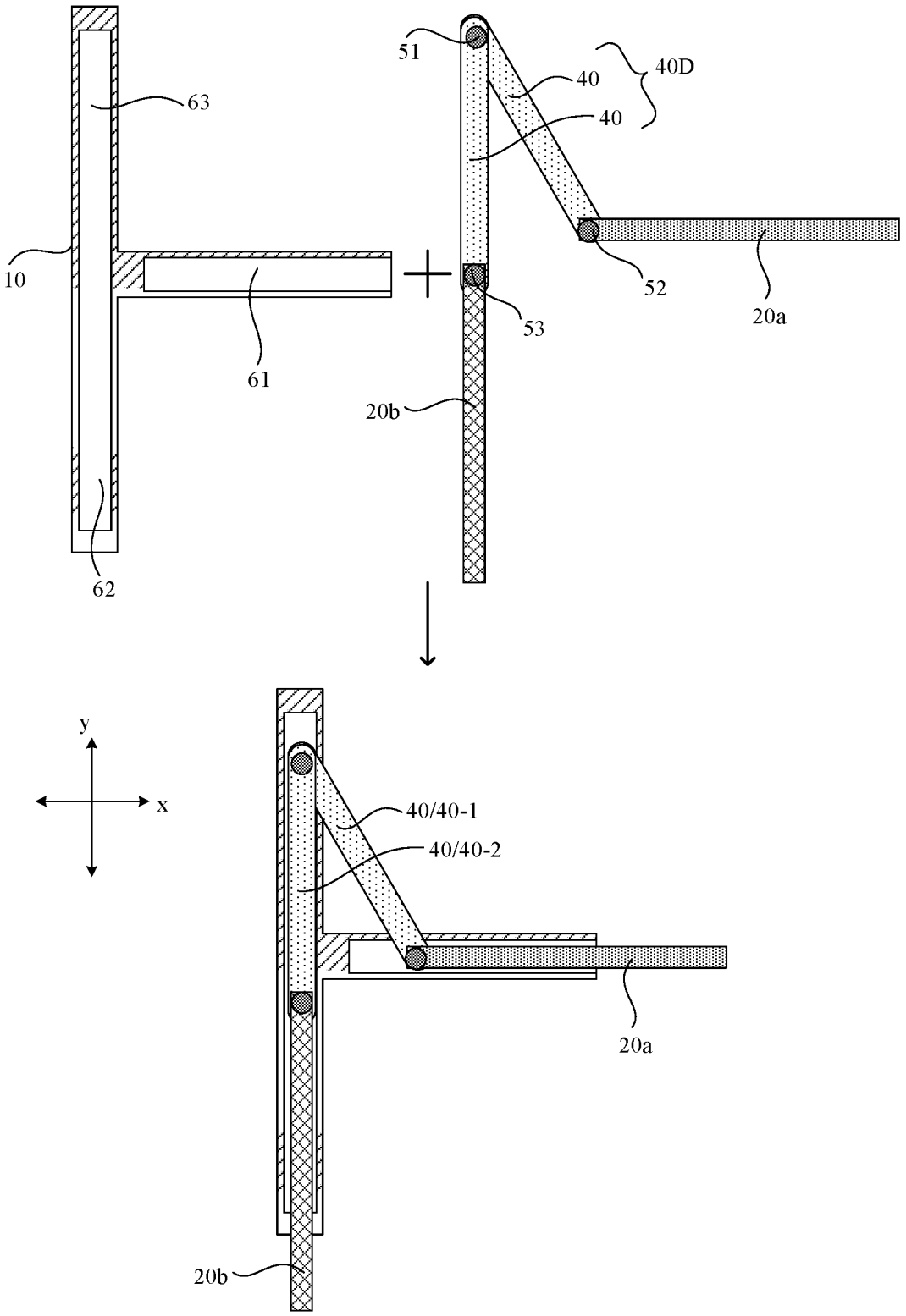
FIG. 9 is a partial schematic diagram of a connecting portion of a retractable apparatus according to another embodiment of the present disclosure.

FIG. 9 is a partial schematic diagram of connecting portions of a retractable apparatus according to an embodiment of the present disclosure. In another embodiment, FIG. 9 illustrates two transmission rods 40 of one transmission rod pair 40D, a first connecting rod 20*a* and a second connecting rod 20*b* that are respectively connected to the two transmission rods 40 of the transmission rod pair 40D, and a first chute 61, a second chute 62, and a third chute 63 that are in one of the connecting portions. In this embodiment, the first rotationally connecting member 51 is limited in the third chute 63 and drives the first ends of the two transmission rods 40 to slide along the third chute 63; the second end of one transmission rod 40 is connected to the first connecting rod 20*a* through the second rotationally connecting member 52, and the second rotationally connecting member 52 is limited in the first chute 61 and drives the second end of one transmission rod 40 to slide along the first chute 61; and the second end of the other transmission rod 40 is connected to the second connecting rod 20*b* through the third rotationally connecting member 53, and the third rotationally connecting member 53 is limited in the second chute 62 and drives the second end of the other transmission rod 40 to slide along the second chute 62. This embodiment can realize a linkage between the first connecting rod and the second connecting rod that are connected to a same connecting portion, and then realize a correlation between the retractable state of the stretchable mechanism in the first direction and the retractable state thereof in the second direction.

In an embodiment, still referring to FIG. 8, the first chute 61 extends along the first direction x, the second chute 62 extends along the second direction y, the third chute 63 extends along a third direction z, and the third direction z is intersected with both the first direction x and the second direction y. The third chute 63 is located between the first chute 61 and the second chute 62. Three chutes are arranged in a divergent manner and extension lines of the three chutes converge at a central point O. In an embodiment, extension directions of the first chute 61 and the second chute 62 intersect with each other, the second rotationally connecting member 52 connected to the first connecting rod 20*a* is limited in the first chute 61, and the third rotationally connecting member 53 connected to the second connecting rod 20*b* is limited in the second chute 62, so that when the second connecting rod 20*b* drives the third rotationally connecting member 53 to move in the second direction y, the second rotationally connecting member 52 can be driven by the transmission rod pair 40D to move in the first direction x, so as to realize a correlation between two connecting rods connected to the same connecting portion and extending in different directions and then realize a correlation of a retractable state of at least three non-collinearly connected connecting portions in the first direction x with a retractable state of the at least three non-collinearly connected connecting portions in the second direction y.

The plurality of connecting portions of the stretchable mechanism 00 are arranged in an array. A first one of the connecting portions 10 is connected to a second one of the connecting portions 10 adjacent thereto in a retractable manner in the first direction x through the first connecting rod 20*a*, and is connected to a third connecting portion 10 adjacent thereto in a retractable manner in the second direction y through the second connecting rod 20*b*. A retractable manner between the connecting portions and the connecting rod is described through a transmission manner between the transmission rod pair 40D of the second connecting portion 10-2 in the three non-collinearly arranged connecting portions and the connecting rod.

It can be understood with reference to FIG. 7 and FIG. 8 that one transmission rod pair 40D includes two transmission rods, i.e., a transmission rod 40-1 and a transmission rod 40-2. For one second connecting portion 10-2, the second connecting rod 20*b* drives the second end of the transmission rod 40-2 connected thereto to move along the second chute 62 and away from the central point O, to realize the stretching between the second connecting portion 10-2 and the second connecting rod 20*b*; the second end of the transmission rod 40-2 moves away from the central point O to drive the first end of the transmission rod 40-2 and the first end of the other transmission rod 40-1 to move along the third chute 63 and away from the central point O, then drives the second end of the other transmission rod 40-1 to move along the first chute 61 and away from the central point O, and then drives the first connecting rod 20*a* connected to the other transmission rod 40-1 to move away from the central point O, to realize the stretching between the second connecting portion 10-2 and the first connecting rod 20*a*. That is, stretching between the connecting portion and the second connecting rod 20*b* can drive stretching between the connecting portion and the first connecting rod 20*a*. The connecting portions 10 of the stretchable mechanism 00 that are arranged in the first direction x are connected to each other in a retractable manner through the first connecting rod 20*a*, and the connecting portions 10 arranged in the second direction y are connected to each other in a retractable manner through the second connecting rod 20*b*, so that the stretchable mechanism can stretch in the first direction x when stretching in the second direction y. That is, the stretching of the stretchable mechanism in the first direction x and the stretching in the second direction y are performed simultaneously.

The second connecting rod 20*b* drives the second end of the transmission rod 40-2 connected thereto to move along the second chute 62 and towards the central point O, to realize the contraction between the second connecting portion 10-2 and the second connecting rod 20*b*; the second end of the transmission rod 40-2 moves toward the central point O to drive the first end of the transmission rod 40-2 and the first end of the other transmission rod 40-1 to move along the third chute 63 and towards the central point O, then drives the second end of the other transmission rod 40-1 to move along the first chute 61 and towards the central point O, and then drives the first connecting rod 20*a* connected to the other transmission rod 40-1 to move toward the central point O, to realize the contraction between the second connecting portion 10-2 and the first connecting rod 10*a*. That is, contraction between the connecting portion and the second connecting rod 20*b* can drive contraction between the connecting portion and the first connecting rod 20*a*. The connecting portions 10 of the stretchable mechanism 00 that are arranged in the first direction x are connected in a retractable manner through the first connecting rod 20*a*, and the connecting portions 10 arranged in the second direction y are connected in a retractable manner through the second connecting rod 20*b*, so that the stretchable mechanism can drive its contraction in the first direction x when contracting in the second direction y. That is, the contraction of the stretchable mechanism in the first direction x and the contraction in the second direction y are performed simultaneously.

It can be known from the above description that the embodiment of the present disclosure can realize a linkage of the retractable state of the stretchable mechanism 00 in the first direction x to the retractable state in the second direction y, and the stretchable mechanism 00 simultaneously stretches or simultaneously contracts in both the first direction x and the second direction y. In applications, the distortion of a display screen caused by a change in an aspect ratio after the stretching of the display panel can be avoided. The retractable state of the stretchable mechanism 00 in the first direction x and the retractable state in the second direction y do not need to be controlled independently, which can simplify a control method.

In an embodiment, still referring to FIG. 8, for one transmission rod pair 40D, the two transmission rods thereof are configured to rotate relative to each other in the first plane to form an angle θ close to the central point, where $0°<\theta<180°$. The angle θ satisfying a particular range enables the two transmission rods 40 of the transmission rod pair 40D and the two connecting rods 20 that are respectively connected to the two transmission rods 40 to be arranged in a shape similar to W, to realize the transmission between the first connecting rod 20*a* and the second connecting rod 20*b* that extend in different directions through the transmission rod pair 40D. At the same time, this can also ensure that the connecting portions occupy a small space when stretching and contraction are available in the same length range.

In an embodiment of the present disclosure, the connecting portion includes at least three transmission rod pairs; two second ends of two transmission rods of a first pair of the at least three transmission rod pairs are respectively connected to one second end of one transmission rod of a second pair of the at least three transmission rod pairs through one rotationally connecting member, and one second end of one transmission rod of a third pair of the at least three transmission rod pairs through another rotationally connecting member; and one transmission rod of one of two transmission rod pairs of the at least three transmission rod pairs and one transmission rod of the other one of the two transmission rod pairs are connected to the connecting rod through the rotationally connecting member. Such configuration can realize that one connecting portion is connected to multiple connecting portions in a retractable manner in all directions thereof in the first plane, so that the multiple connecting portions form a stretchable mechanism capable of stretching or contracting in both the first direction and the second direction.

Figure 10:
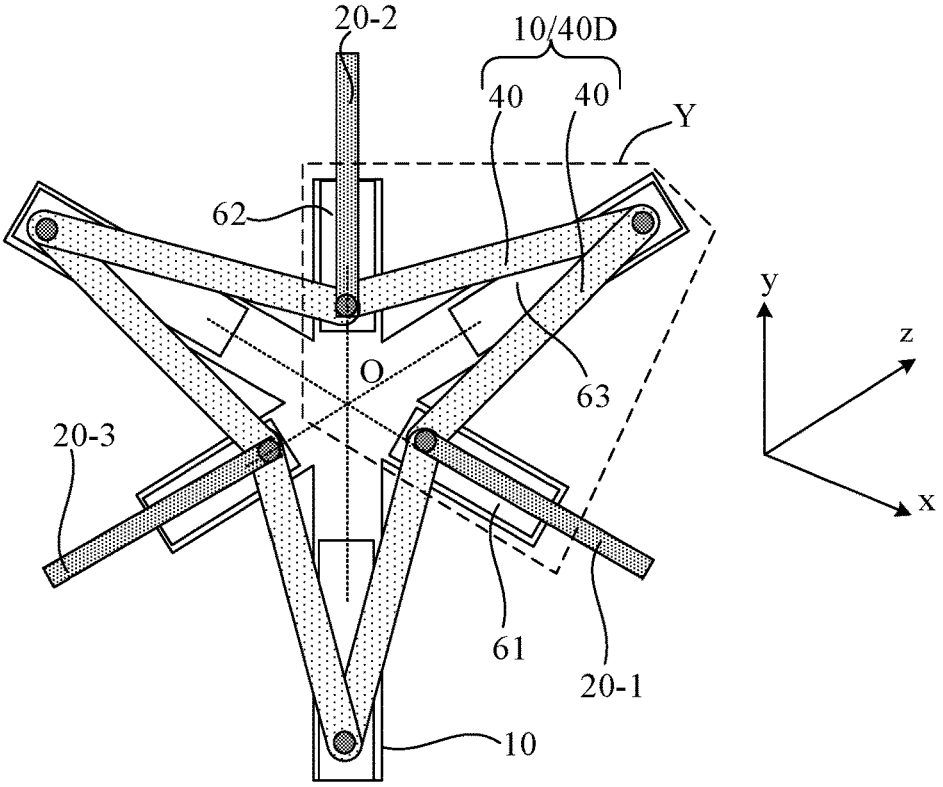
FIG. 10 is a schematic diagram of a connecting portion of a retractable apparatus according to another embodiment of the present disclosure.

FIG. 10 is a schematic diagram of a connecting portion of a retractable apparatus according to an embodiment of the present disclosure. In an embodiment, as shown in FIG. 10, the connecting portion 10 includes three transmission rod pairs 40D, two first ends of two transmission rods 40 of a first transmission rod pair 40D are rotationally connected through a rotationally connecting member, one second end of a first transmission rod of the two transmission rods 40 of the first transmission rod pair 40D and one second end of a second transmission rod of the two transmission rods 40 of the first transmission rod pair 40D are respectively rotationally connected to one second end of one of the two transmission rods 40 of a second transmission rod pair 40D and one second end of one of the two transmission rods 40 of a third transmission rod pair 40D, and the second end of the transmission rod 40 is rotationally connected to the connecting rods 20 through a rotationally connecting member. A region circled by the dotted line in FIG. 10 is a structural unit Y similar to the structure shown in the embodiment of FIG. 8. In an embodiment shown in FIG. 10, one connecting portion 10 can be connected to three connecting rods, i.e., connecting rods 20-1, 20-2, and 20-3. Extension directions of the connecting rods 20-1, 20-2, and 20-3 are all different. FIG. 10 illustrates that extension directions of the chutes converge at a central point O. When the connecting rod 20-1 moves away from the central point O, the connecting rod 20-1 can drive two transmission rods 40 that are respectively located in two connecting rod pairs 40D and connected to the connecting rod 20-1, to move in the corresponding chutes and away from the central point O, and then drive the connecting rod 20-2 and the connecting rod 20-3 to move away from the central point O, so as to realize a stretching state between the three connecting rods and the connecting portion 10. This embodiment can realize a correlation between three retractable states: a retractable state between the connecting rod 20-1 and the connecting portion 10, a retractable state between the connecting rod 20-2 and the connecting portion 10, and a retractable state between the connecting rod 20-3 and the connecting portion 10. Contraction states of the three connecting rods and the connecting portion 10 can be understood with reference to the above, and are not repeated herein.

Figure 11:
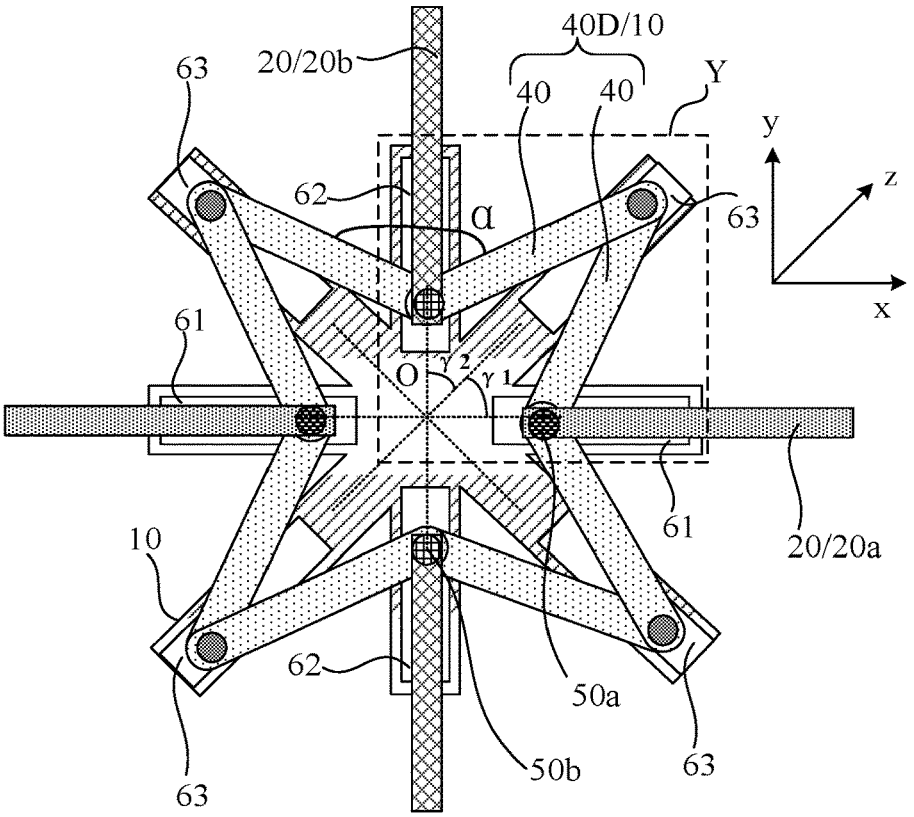
FIG. 11 is a partial schematic diagram of a connecting portion of a retractable apparatus according to another embodiment of the present disclosure.

FIG. 11 is a partial schematic diagram of a connecting portion of a retractable apparatus according to an embodiment of the present disclosure. In an embodiment, as shown in FIG. 11, the connecting portion 10 includes four transmission rod pairs 40D; and the at least one chute includes two first chutes 61, two second chutes 62, and four third chutes 63, and extension lines of the eight chutes converge at the central point O. The first chutes 61 and the second chutes 62 are spaced apart from each other, and one third chute 63 is disposed between the first chute 61 and the second chute 62 that are adjacent to each other. One rotationally connecting member 50*a* connecting two transmission rods 40 respectively belonging to two transmission rod pairs 40D is limited in the first chute 61; and one rotationally connecting member 50*b* connecting the two transmission rods 40 respectively belonging to the two transmission rod pairs 40D is limited in the second chute 62. In the first plane, one of the two transmission rods 40 of one of the four transmission rod pairs 40D and one of the two transmission rods 40 of another one of the four transmission rod pairs 40D are connected to each other, and a side, away from the central point O, of the one of the two transmission rods 40 of one of the four transmission rod pairs 40D, and a side, away from the central point O, of the one of the two transmission rods 40 of another one of the four transmission rod pairs 40D form an angle α, where 180°≥α>90°. The embodiment shown in FIG. 11 includes four angles α, of which only one is indicated in FIG. 11.

In this embodiment, transmission is performed between two connecting rods 20 that are connected to a same connecting portion through the transmission rod pairs 40D. A region circled by the dotted line in FIG. 11 is a structural unit Y similar to the structure shown in the embodiment of FIG. 8. Four structural units Y can be delineated in the embodiment of FIG. 11. Two adjacent structural units Y share at least one structure (such as, sharing the first chute 61 or the second chute 62). Each structural unit Y includes a third chute 63. Therefore, the embodiment of FIG. 11 includes four third chutes 63, and the four third chutes 63 extend in different direction. For example, two of the four third chutes 63 extend along a same straight line in the first plane, and the other two of the four third chutes 63 extend in a same straight line in the first plane. A transmission manner between the connecting rod 20 and the transmission rod 40 in one structural unit Y can be understood with reference to the embodiment shown in FIG. 8, and is not repeated herein.

In an embodiment, still referring to FIG. 11, in the first plane, an angle formed between the first chute 61 and the third chutes 63 adjacent thereto is γ1, and an angle formed between the second chute 62 and the third chute 63 adjacent thereto is γ2, where |γ1−γ2|≤10°. A relationship between a value of the angle γ1 and a value of the angle γ2 affects lengths of the two transmission rods 40 in one transmission rod pair 40D, and then can affect sliding displacement of the two connecting rods 20 driven through the transmission rod pair 40D in respective extension directions. That is, by adjusting the relationship between the value of the angle γ1 and the value of the angle γ2, the second connecting rod 20*b* can be controlled to move a distance of d2 away from the central point O to drive the first connecting rod 20*a* to move a distance of d1 away from the central point O. A relationship between the distance d2 and the distance d1 is related to the angle γ1 and the angle γ2. In applications, the plurality of connecting portions are arranged in an array, so that when the stretchable mechanism 00 simultaneously stretches in the first direction x and the second direction y, a stretching ratio in the two directions can be controlled to meet the application of stretchable display panels of different shapes and sizes, and a display screen ratio of the stretchable display panel changes little or does not change before and after stretching, thereby ensuring good visual experience.

In an embodiment, γ1=γ2. That is, within a range of process error, a difference of values between the angle γ1 and the angle γ2 is small, so that lengths of two transmission rods 40 in one transmission rod pair 40D can be set as basically the same. During production, the transmission rods 40 being of a substantially same size makes a production process simple. For example, a structure including four transmission rod pairs 40D is axisymmetric in the first plane. When stretching or contracting between the connecting portion and the connecting rod, the force applied on the transmission rods is relatively uniform, and the overall stability of the connecting portion is higher.

In an embodiment, in the first plane, an extension direction of the first chute 61 is perpendicular to an extension direction of the second chute 62. Referring to the structure of the connecting portion illustrated in FIG. 11, the extension direction of the first chute 61 is perpendicular to the extension direction of the second chute 62, that is, the first direction x is perpendicular to the second direction y. In applications, the connecting portion in the embodiment of FIG. 11 is connected to four connecting rods 20 in a retractable manner, two of the four connecting rods 20 are respectively connected to two different rotationally connecting members limited in two first chutes 61, and the other two connecting rods 20 are respectively connected to two different rotationally connecting members limited in two second chutes 62. That is, two sides of one connecting portion are connected, in a retractable manner, to two first connecting rods 20*a* extending in the first direction x, and the other two sides of the connecting portions are connected, in a retractable manner, to two second connecting rods 20*b* extending in the second direction 20*b*, so that in the stretchable mechanism 00, connecting portions adjacent to each other in the first direction x are retractable, connecting portions adjacent to each other in the second direction y are retractable, and retractable states in the two directions are correlated. Thus, the stretchable mechanism 00 stretches or contracts in the two directions perpendicular to each other in the first plane, so as to support the retractable state of the retractable display panel and ensure that the force in all directions is relatively uniform during stretching or contraction of the retractable display panel.

The structure of the stretchable mechanism including the connecting portions provided in the embodiment of FIG. 11 can be obtained with reference to the embodiment of FIG. 7.

Figure 12:
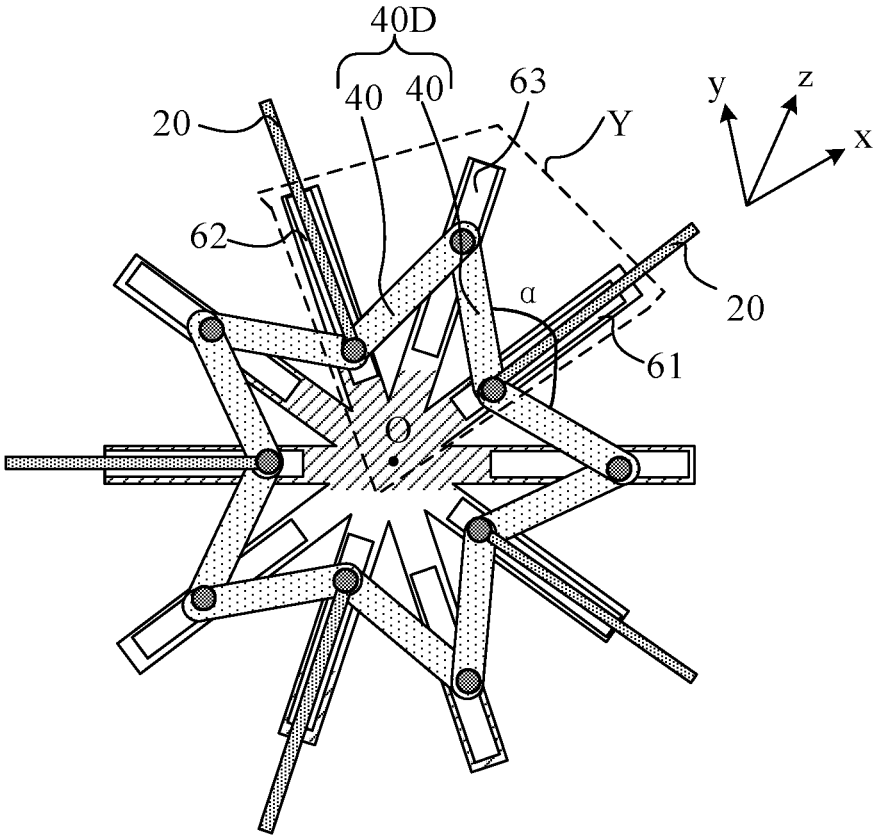
FIG. 12 is a partial schematic diagram of a connecting portion of a retractable apparatus according to another embodiment of the present disclosure.

FIG. 12 is a partial schematic diagram of a connecting portion of a retractable apparatus according to an embodiment of the present disclosure. In an embodiment, as shown in FIG. 12, the connecting portion includes five transmission rod pairs 40D. A region circled by the dotted line in FIG. 12 is a structural unit Y similar to the structure shown in the embodiment of FIG. 8. Five structural units Y can be delineated in the embodiment of FIG. 12. Two adjacent structural units Y share at least one structure (sharing the first chute 61 or the second chute 62). Each structural unit Y includes a third chute 63. Therefore, the embodiment of FIG. 12 includes five third chutes 63, and the five third chutes 63 extend in five different directions. The connecting portion in the embodiment of FIG. 12 include ten chutes. Extension lines of the ten chutes all converge at a central point O. One rotationally connecting member connecting two transmission rods 40 respectively belonging to two transmission rod pairs 40D is limited in the first chute 61; another rotationally connecting member connecting the two transmission rods 40 respectively belonging to two transmission rod pairs 40D is limited in the second chute 62; and in the first plane, two transmission rods 40 connected to each other and respectively belonging to two transmission rod pairs 40D and form an angle α at a side away from the central point O, where 180°≥α>90°. The embodiment of FIG. 12 includes five angles α, of which only one is indicated in FIG. 12. A transmission mechanism between the connecting rod 20 and the transmission rod 40 in one structural unit Y in the embodiment of FIG. 12 can be understood with reference to the embodiment in FIG. 8, and is not repeated herein. In this embodiment, in the first plane, one connecting portion can be connected in a retractable manner, in all directions thereof, to at most five connecting rods 20 in different extension directions, so that the connecting portion can be connected, in a retractable manner, to corresponding adjacent connecting portions in five directions around it. Through the arrangement of the connecting portions of the stretchable mechanism, the stretchable mechanism can stretch and contract in the first plane in all directions thereof.

In an embodiment, referring to FIG. 9, the first chute 61 extends along the first direction x, and the second chute 62 and the third chute 63 both extend along the second direction y, the second chute 62 and the third chute 63 are arranged in the second direction y, and the first chute 61 is located on a same side of the second chute 62 and the third chute 63. In the embodiment, extension directions of the first chute 61 and the second chute 62 intersect with each other, the second rotationally connecting member 52 connected to the first connecting rod 20*a* is limited in the first chute 61, and the third rotationally connecting member 53 connected to the second connecting rod 20*b* is limited in the second chute 62, so that when the second connecting rod 20*b* drives the third rotationally connecting member 53 to move in the second direction y, the second rotationally connecting member 52 can be driven by the transmission rod pair 40D to move in the first direction x, so as to realize a correlation between two connecting rods connected to a same connecting portion and extending in different directions and then realize a correlation of a retractable state of at least three connecting portions non-collinearly connected in the first direction x with a retractable state thereof in the second direction y.

The embodiment of FIG. 9 shows that the second chute 62 and the third chute 63 are in communication with each other. In another embodiment, the second chute 62 is not communicated with and the third chute 63.

In an embodiment, a retractable manner between the connecting portions and the connecting rod is described through a transmission manner between the connecting rod and the transmission rod pair 40D of the second connecting portion 10-2 in the three connecting portions that are non-collinearly arranged.

It can be understood with reference to FIG. 9 that one transmission rod pair 40D includes two transmission rods, i.e., a transmission rod 40-1 and a transmission rod 40-2. For one second connecting portion 10-2, the second connecting rod 20*b* drives the second end of the transmission rod 40-2 connected thereto to move along the second chute 62 and away from the third chute 63, to realize the stretching between the second connecting portion 10-2 and the second connecting rod 20*b*; the second end of the transmission rod 40-2 moves away from the third chute 63 to drive the first end of the transmission rod 40-2 and the first end of the other transmission rod 40-1 to move along the third chute 63 and towards the second chute 62, and then drives the second end of the other transmission rod 40-1 to move along the first chute 61 and away from the third chute, to realize the stretching between the second connecting portion 10-2 and the first connecting rod. That is, the stretching between the connecting portion and the second connecting rod 20*b* can drive the stretching between the connecting portion and the first connecting rod 20*a*. The connecting portions 10 of the stretchable mechanism 00 that are arranged in the first direction x are telescopically connected through the first connecting rod 20*a*, and the connecting portions 10 arranged in the second direction y are telescopically connected through the second connecting rod 20*b*, so that the stretchable mechanism can drive its stretching in the first direction x when stretching in the second direction y. That is, the stretching of the stretchable mechanism in the first direction x and the stretching in the second direction y are performed simultaneously.

The second connecting rod 20*b* drives the second end of the transmission rod 40-2 connected thereto to move along the second chute 62 and towards the third chute 63, to realize the contraction between the second connecting portion 10-2 and the second connecting rod 20*b*; the second end of the transmission rod 40-2 moves toward towards the third chute 63 to drive the first end of the transmission rod 40-2 and the first end of the other transmission rod 40-1 to move along the third chute 63 and away from the second chute 62, and then drives the second end of the other transmission rod 40-1 to move along the first chute 61 and towards the third chute 63, to realize the contraction between the second connecting portion 10-2 and the first connecting rod 20*a*. That is, the contraction between the connecting portion and the second connecting rod 20*b* can drive the contraction between the connecting portion and the first connecting rod 20*a*. The connecting portions 10 of the stretchable mechanism 00 that are arranged in the first direction x are telescopically connected through the first connecting rod 20*a*, and the connecting portions 10 arranged in the second direction y are telescopically connected through the second connecting rod 20*b*, so that the stretchable mechanism can drive its contraction in the first direction x when contracting in the second direction y. That is, the contraction of the stretchable mechanism in the first direction x and the contraction in the second direction y are performed simultaneously.

Figure 13A:
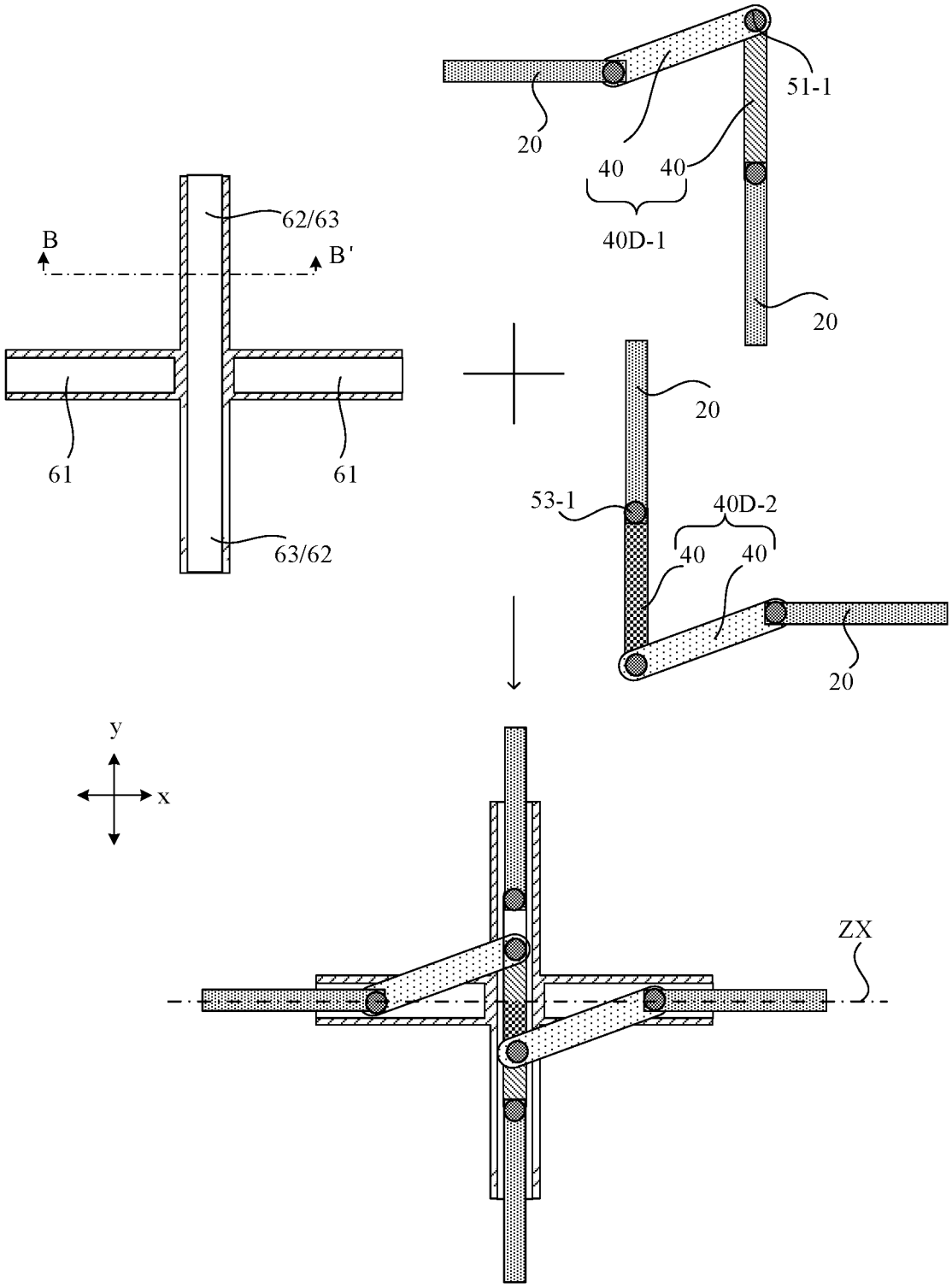
FIG. 13A is a schematic diagram of a connecting portion of a retractable apparatus according to another embodiment of the present disclosure.
Figure 13B:
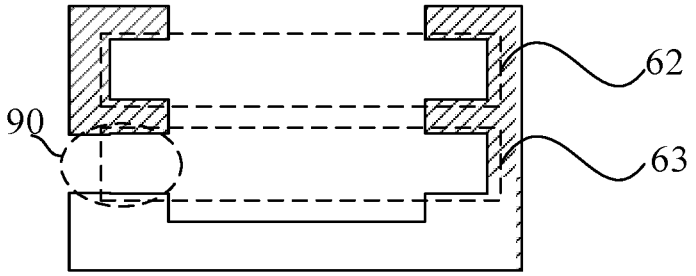
FIG. 13B is a schematic cross-sectional view along a tangent line B-B' shown in FIG. 13A according to an embodiment of the present disclosure.

FIG. 13A is a schematic diagram of a connecting portion of a retractable apparatus according to an embodiment of the present disclosure. FIG. 13B is a schematic cross-sectional view along a tangent line B-B' shown in FIG. 13A. As shown in FIG. 13A, the connecting portion includes at least two transmission rod pairs 40D, which are respectively a transmission rod pair 40D-1 and a transmission rod pair 40D-2. In the first plane, two transmission rod pairs 40D are disposed in reverse symmetry along an axis ZX, and the axis ZX is a central symmetry line between the third chute 63 and the second chute 62. Reverse symmetry is understood as that one transmission rod pair 40D rotates by a certain angle and then is symmetric with another transmission rod pair 40D about the axis ZX. The chutes includes two first chutes 61, two second chutes 62, and two third chutes 63, and the two first chutes 61 are respectively located on two sides of the second chutes 62 in the second direction y and are respectively located on two sides of the third chutes 63 in the second direction y. The second chute 62 cooperating with one transmission rod pair 40D-1 and the third chute 63 cooperating with the other transmission rod pair 40D-2 are located at a same side of the first chutes 61.

In this embodiment, since the second chute 62 and the third chute 63 that respectively cooperate with the two transmission rod pairs 40D are located on the same side of the first chute 61, this second chute 62 and this third chute 63 overlap in the top view of FIG. 13A, that is, the second chute 62 and the third chute 63 overlap in a direction perpendicular to the first plane. In order to ensure that the two transmission rod pairs 40D can transmit corresponding connecting rods 20, at a first side of the first chute 61, a first one of the two second chutes 62 is located above a first one of the two third chutes 63; and at a second side of the first chute 61 opposite to the first side, a second one of the two second chutes 62 is located below a second one of the two third chutes 63.

As illustrated in the cross-sectional view of FIG. 13B, at a side of the first chute where the line BB' is located, the first one of the two second chutes 62 and the first one of the two third chutes 63 overlap, and a third rotationally connecting member 53-1 rotationally connected to one transmission rod 40 of the transmission rod pair 40D-2 and the connecting rod 20 is limited in the second chute 62, so as to drive the connecting rod 20 and the transmission rod 40 to slide along the second chute 62. A first rotationally connecting member 51-1 rotationally connected to first ends of two transmission rods 40 of the other transmission rod pair 40D-1 is limited in the third chute 63, so as to drive the first ends of the two transmission rods 40 to slide along the third chute 63. In this embodiment, the third chute 63 is located below the second chute. FIG. 13B further illustrates an opening 90. The opening 90 is configured to accommodate the transmission rod 40 so as to enable the first end thereof to be connected to the first rotationally connecting member 51-1 limited in the third chute 63, and the opening 90 extends in the same direction as the third chute 63 so that the transmission rod 40 can move under the driving of the connecting rod 20.

Figure 13C:
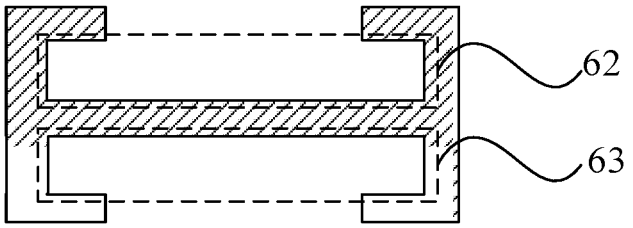
FIG. 13C is a schematic cross-sectional view along a tangent line B-B' shown in FIG. 13A according to an embodiment of the present disclosure.

FIG. 13B illustrates a structure in an embodiment where the second chute 62 and the third chute 63 overlap. In another embodiment, FIG. 13C is another cross-sectional view along tangent line B-B' shown in FIG. 13A. As shown in FIG. 13C, the second chute 62 and the third chute 63 are respectively disposed on upper and lower sides of a main structure where the chutes are located. That is, the second chute 62 and the third chute 63 are respectively disposed on front and back sides of the main structure where the chutes are located. Such a configuration can conveniently limit the third rotationally connecting member 53-1 in the second chute 62, and also conveniently limit the first rotationally connecting member 51-1 in the third chute 63, and the movement of the transmission rod 40 driven by the third rotationally connecting member 53-1 and the movement of the transmission rod 40 driven by the first rotationally connecting member 51-1 do not interfere with each other.

In this embodiment, a transmission manner between two transmission rod pairs 40D and corresponding two connecting rods can be understood with reference to the corresponding description in the embodiment of FIG. 9. The two transmission rod pairs 40D are in reverse symmetry along an axis, so that one connecting portion can be telescopically connected to at most four connecting rods, and two of the four connecting rods 20 extend in a direction, and the other two of the four connecting rods extend in another direction. For four connecting rods 20 connected to one connecting portion, two connecting rods 20 extend along the first direction x, and the other two connecting rods 20 extend along the second direction y. Thus, in the stretchable mechanism 00, connecting portions adjacent in the first direction x are retractable, connecting portions adjacent in the second direction y are retractable, and retractable states of two connecting rods driven by one connecting rod pair in two directions are correlated. Thus, the stretchable mechanism 00 simultaneously stretches or simultaneously contracts in the first direction x and the second direction y, so as to support the retractable display panel.

Figure 14:
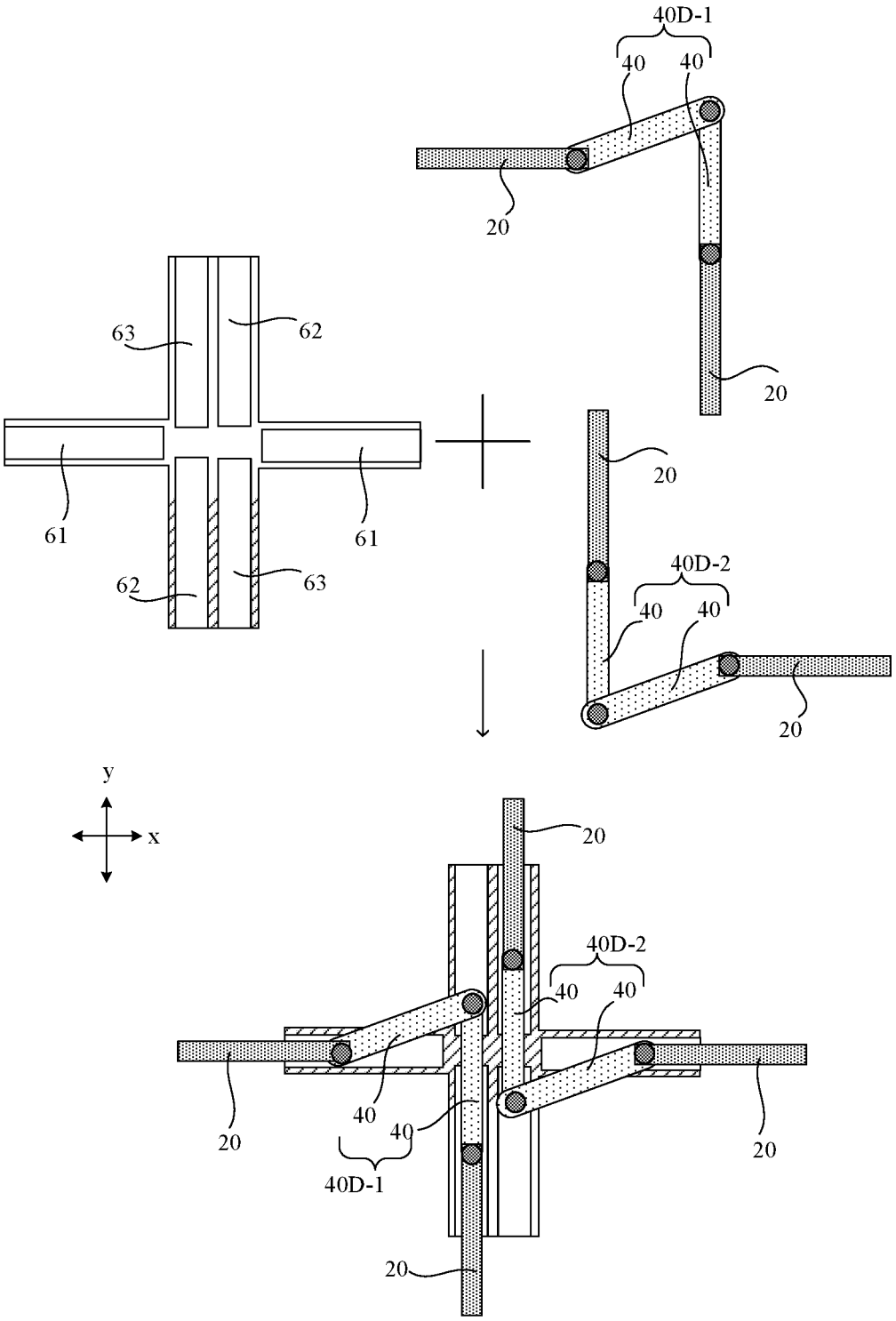
FIG. 14 is a schematic diagram of a connecting portion of a retractable apparatus according to another embodiment of the present disclosure.

In an embodiment, the configurations of the second chute and the third chute are different from those in the embodiment of FIG. 13A. FIG. 14 is a schematic diagram of a connecting portion of a retractable apparatus according to an embodiment of the present disclosure. As shown in FIG. 14, the connecting portion includes two transmission rod pairs 40D, which are respectively a transmission rod pair 40D-1 and a transmission rod pair 40D-2. In the first plane, the two transmission rod pairs 40D are disposed in reverse symmetry, and the chutes include two first chutes 61, two second chutes 62, and two third chutes 63. The two first chutes 61 are respectively located at two sides of each of the second chutes 62 in the second direction y and located at two sides each of the third chutes 63 in the second direction y. The second chute 62 cooperating with the transmission rod pair 40D-1 and the third chute 63 cooperating with the transmission rod pair 40D-2 are located on the same side of each of the two first chutes 61, and the second chute 62 cooperating with the transmission rod pair 40D-1 and the third chute 63 cooperating with the transmission rod pair 40D-2 are parallel to each other in the first plane. The third chute 63 cooperating with the transmission rod pair 40D-1 and the second chute 62 cooperating with the transmission rod pair 40D-2 are parallel to each other in the first plane. In this embodiment, the second chutes 62 and the third chutes 63 are arranged in the first plane, which reduces a thickness of the stretchable mechanism and then thins an overall thickness of the retractable apparatus.

In some embodiments, the first direct x and the second direction y in the embodiment of FIG. 14 are perpendicular to each other, that is, the extension direction of the first chute 61 and the extension direction of the second chute 62 are perpendicular to each other. The connecting portion illustrated in the embodiment of FIG. 14 are arranged in an array, so that the stretchable mechanism can simultaneously stretch or simultaneously contract in the two directions perpendicular to each other in the first plane, which can support the retractable state of the stretchable display panel and ensure that the force in all directions is relatively uniform during stretching or contraction of the stretchable display panel.

Figure 15:
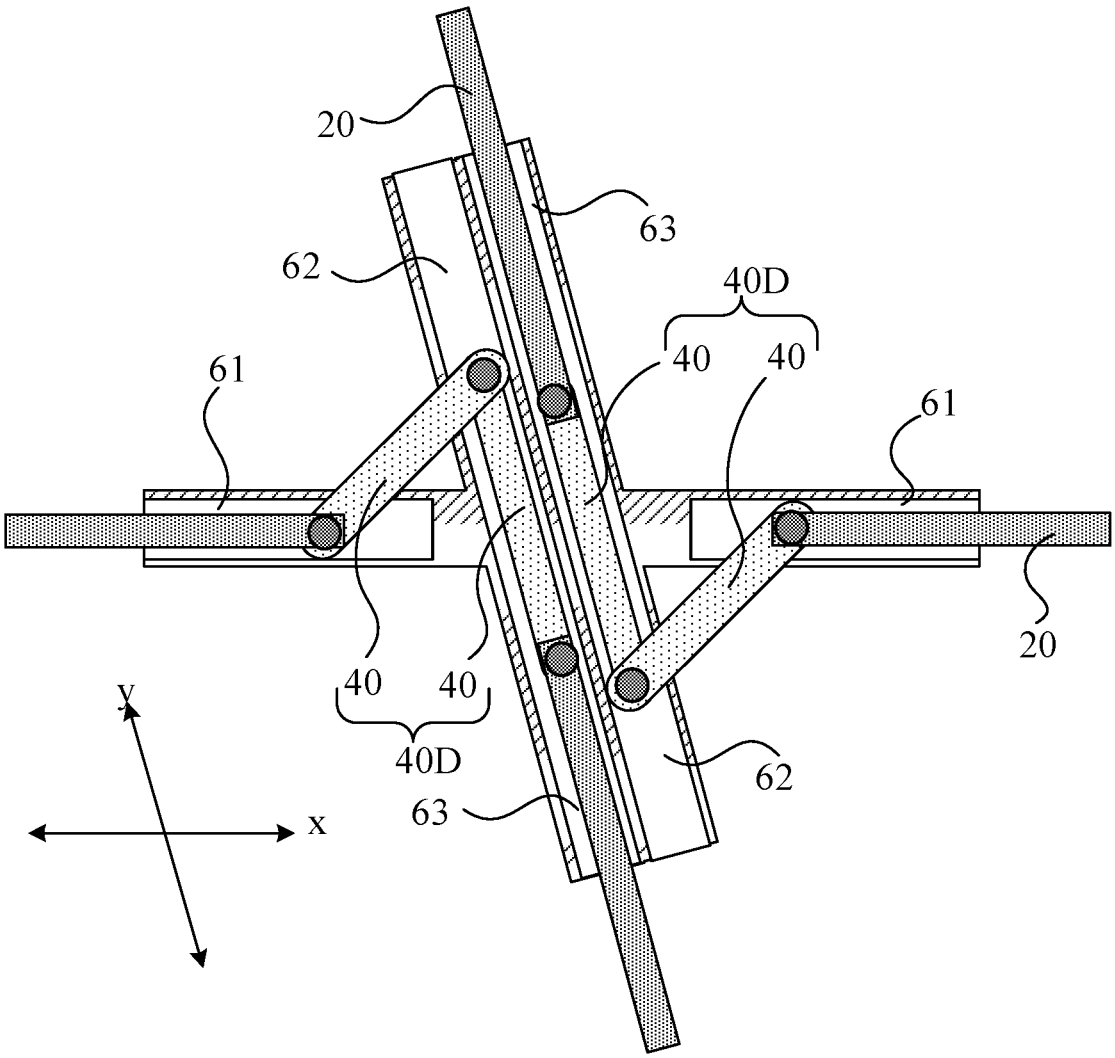
FIG. 15 is a schematic diagram of a connecting portion of a retractable apparatus according to another embodiment of the present disclosure.

FIG. 15 is a schematic diagram of a connecting portion of a retractable apparatus according to an embodiment of the present disclosure. In another embodiment, as shown in FIG. 15, the connecting portion includes two transmission rod pairs 40D. In the first plane, the two transmission rod pairs 40D are disposed in reverse symmetry, and the chutes include two first chutes 61, two second chutes 62, and two third chutes 63. The first chutes 61 extend along the first direction x, the second chute 62 and the third chute 63 extend along the second direction y, both the first direction x and the second direction y are located in the first plane, and the first direction x and the second direction y form a non-right angle. One connecting portion can be telescopically connected to at most four connecting rods 20, and two of the four connecting rods 20 extend along the first direction x, and the other two connecting rods 20 extend along the second direction y. Through the design of the arrangement of the connecting portions of the stretchable mechanism 00, a retractable state of the stretchable mechanism 00 in the first direction x and a retractable state thereof in the second direction y can be linked to each other, so as to support stretching and contraction of the stretchable display panel 01.

Figure 16:
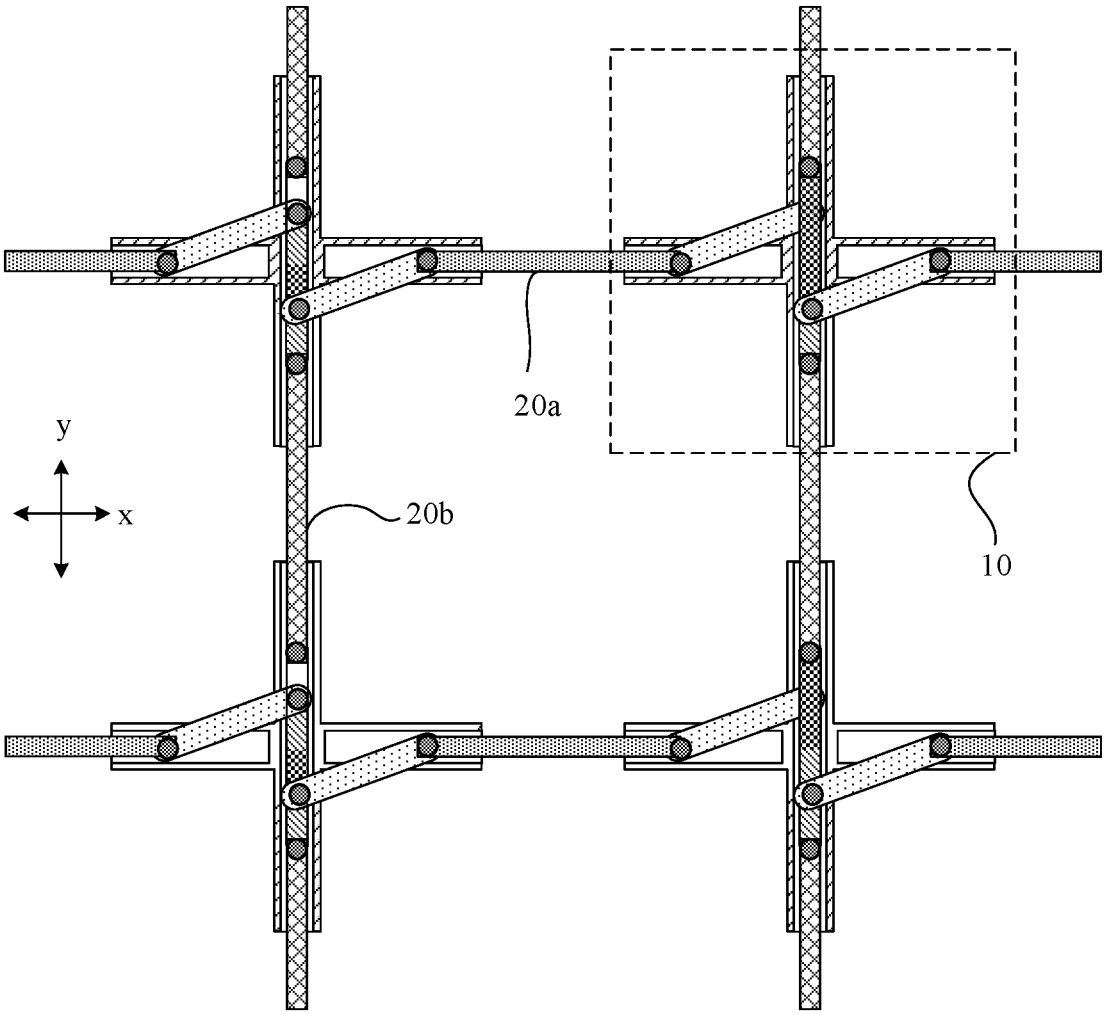
FIG. 16 is a partial schematic diagram of a stretchable mechanism of a retractable apparatus according to another embodiment of the present disclosure.

In an embodiment, taking the structure of the connecting portion in FIG. 13 as an example, FIG. 16 is a partial schematic diagram of a stretchable mechanism of a retractable apparatus according to an embodiment of the present disclosure. As shown in FIG. 16, the connecting portions 10 are arranged in an array in the first plane. In the array formed by the connecting portions, two connecting portions 10 arranged in the first direction x are telescopically connected through the first connecting rod 20*a*, and two connecting portions 10 arranged in the second direction y are telescopically connected through the second connecting rod 20*b*.

Figure 17:
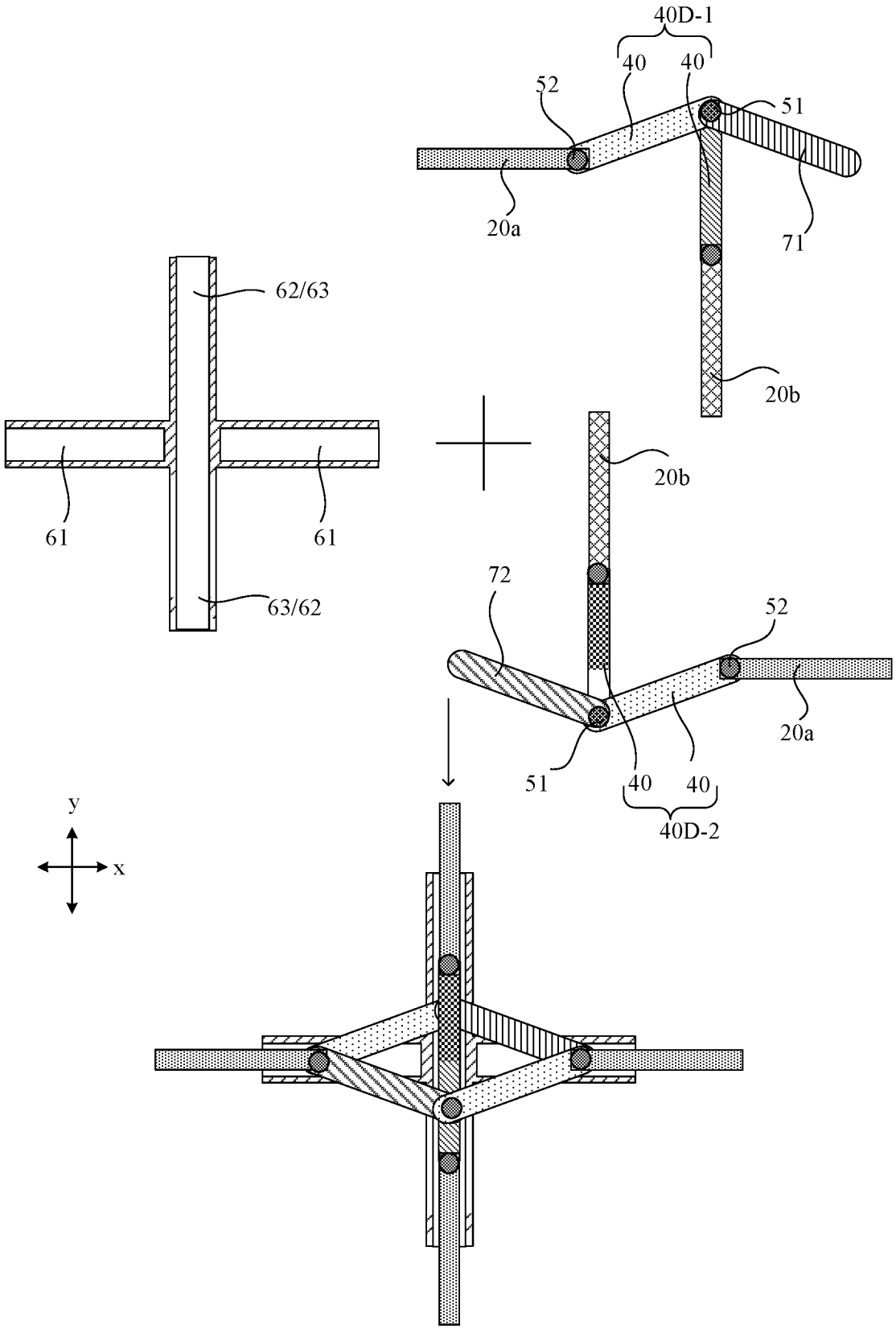
FIG. 17 is a schematic diagram of a connecting portion of a retractable apparatus according to another embodiment of the present disclosure.

FIG. 17 is a schematic diagram of a connecting portion of a retractable apparatus according to an embodiment of the present disclosure. In an embodiment, as shown in FIG. 17, the connecting portion further includes at least one auxiliary rod. The figure illustrates that the connecting portion includes two auxiliary rods, which are respectively a first auxiliary rod 71 and a second auxiliary rod 72. A first end of the first auxiliary rod 71 is connected, through the first rotationally connecting member 51, to first ends of transmission rods 40 in one transmission rod pair 40D-1; and a second end of the first auxiliary rod 71 is connected, through the second rotationally connecting member 52, to the second end of the transmission rod 40 of the other transmission rod pair 40D-2 that is connected to the first connecting rod 20*a*. A first end of the second auxiliary rod 72 is connected, through the first rotationally connecting member 51, to the first ends of the transmission rods 40 of the transmission rod pair 40D-2; and a second end of the second auxiliary rod 72 is connected, through the second rotationally connecting member 52, to the second end of the transmission rods 40 in the other transmission rod pair 40D-1 that is connected to the first connecting rod 20*a*. In this embodiment, two transmission rods 40D are connected to each other through the auxiliary rod, which can not only realize a correlation between retractable states between two connecting rods driven by one transmission rod pair 40D and extending in different directions and the same connecting portion, but also realize a correlation between retractable states between two connecting rods driven by two transmission rod pairs 40D respectively and the same connecting portion, so that the overall structure of the connecting portion is more stable. Through the design of the arrangement of the plurality of connecting portions, the retractable state of the stretchable mechanism 00 in the first direction is correlated with the retractable state thereof in the second direction.

Figure 18:
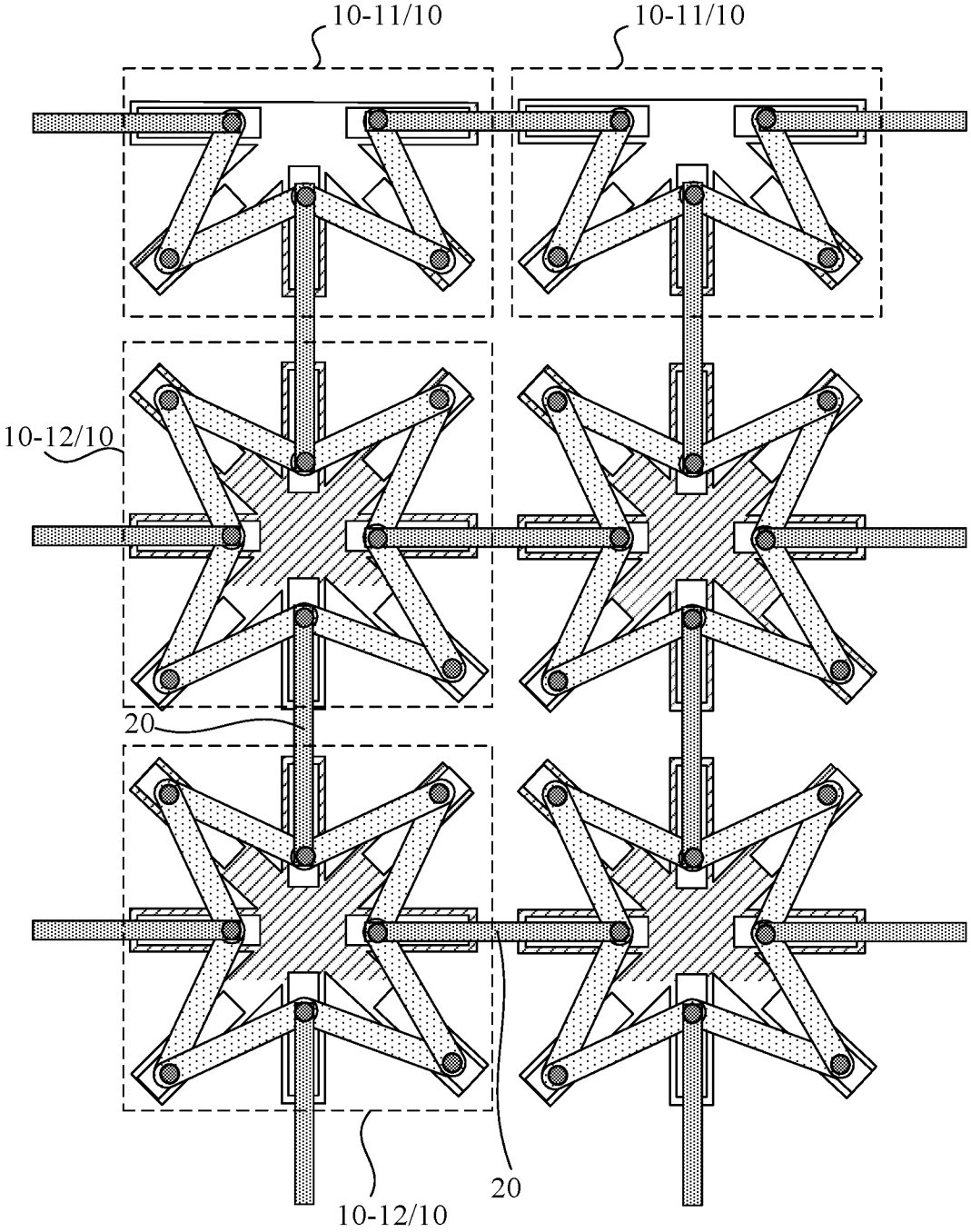
FIG. 18 is a partial schematic diagram of a stretchable mechanism of a retractable apparatus according to another embodiment of the present disclosure.

For example, the plurality of connecting portions are arranged in an array in the stretchable mechanism. FIG. 18 is a partial schematic diagram of a stretchable mechanism of a retractable apparatus according to an embodiment of the present disclosure. As shown in FIG. 18, multiple connecting portions 10 are arranged in an array in the stretchable mechanism. The figure illustrates an edge region of the stretchable mechanism. The connecting portion (the connecting portion 10-11 marked in the figure) located at an edge of the array is not branched at a side away from the center of the array, that is, a side of the connecting portion 10-11 is provided with no transmission structure (e.g., transmission rod pair) at a side away from the center of the array. The connecting portion (the connecting portion 10-12 marked in the figure) not located at an edge of the array is connected to adjacent connecting portions 10 through the connecting rod 20. The center of the array can be understood as a graphical center. For example, when the stretchable mechanism is a regular graph, the center of the array center is a geometric center of the graph of the stretchable mechanism in the first plane.

The connecting portions in FIG. 18 are illustrated with the structure of the connecting portions illustrated in FIG. 12. This embodiment also applies to the structure of the connecting portions in any of the above embodiments. The array arrangement of the connecting portions can be understood with reference to FIG. 18, which is not illustrated herein.

In an embodiment, in the stretchable mechanism, the plurality of connecting portions are arranged in an array in the first plane to form a rectangular structure. In another embodiment, in the stretchable mechanism, the plurality of connecting portions are arranged in an array in the first plane to form a circular structure.

In the embodiment of the present disclosure, the arrangement of the plurality of connecting portions in the stretchable mechanism is designed to match the shape of the stretchable display panel, so as to support the stretchable display panel.

Figure 19:
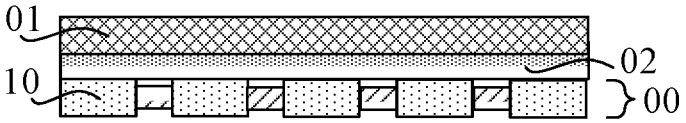
FIG. 19 is a schematic cross-sectional view of a retractable apparatus according to another embodiment of the present disclosure.

FIG. 19 is a cross-sectional view of a retractable apparatus according to an embodiment of the present disclosure. As shown in FIG. 19, the retractable apparatus can further include an auxiliary telescopic structure 02, and the stretchable display panel 01 is connected to the stretchable mechanism 00 through the auxiliary telescopic structure 02. In a plane of the stretchable display panel 01, connection sites of the auxiliary telescopic structure 02 where the auxiliary telescopic structure 02 is connected to the stretchable display panel 01 are uniformly distributed. In applications, telescopic movement of the stretchable mechanism 10 drives the auxiliary telescopic structure 02 to telescopically move, and then the auxiliary telescopic structure 02 assists the stretchable display panel 01 in uniformly stretching or uniformly contracting through the connection sites uniformly connected to the stretchable display panel 01, so that all positions of the stretchable display panel 01 are subjected to force uniformly during stretching and contraction to avoid abnormal display due to the damage of circuit devices in the panel caused by excessive tensile stress in local positions.

In an embodiment, the auxiliary telescopic structure 02 is made of an elastic material. The auxiliary telescopic structure 02 is configured to make the stretchable display panel 01 bear uniform force when the stretchable mechanism 00 drives the stretchable display panel 01 to stretch and contract.

In an embodiment, the auxiliary telescopic structure 02 is uniformly fixed at a plurality of sites of frames around the stretchable mechanism 00 in the first plane, and stretching and contraction of the stretchable mechanism 00 drive the auxiliary telescopic structure 02 to stretch and contract, and then drive the stretchable display panel 01 to stretch and contract.

The above are merely some embodiments of the present disclosure and are not intended to limit the present disclosure. Any modification, equivalent replacement, improvement, and so on made within the principle of the present disclosure shall fall within the protection scope of the present disclosure.

Finally, it should be noted that the above embodiments are merely intended to describe the technical solutions of the present disclosure rather than limiting the present disclosure. Although the present disclosure is described in detail with reference to the above embodiments, those of ordinary skill in the art should understand that they can still make modifications to the technical solutions described in the above embodiments or make equivalent replacements to some or all technical features thereof. Such modifications or replacements do not cause the essence of corresponding technical solutions to depart from the scope of the technical solutions of the embodiments of the present disclosure.

What is claimed is:

1. A retractable apparatus, comprising a stretchable mechanism and a plurality of connecting rods, wherein the stretchable mechanism comprises a plurality of connecting portions arranged in a first plane, wherein adjacent connecting portions of the plurality of connecting portions are connected to each other in a retractable manner, and at least three connecting portions of the plurality of connecting portions are non-collinearly arranged; and wherein the plurality of connecting portions is connected to each other in a retractable manner through the plurality of connecting rods.

2. The retractable apparatus according to claim 1, further comprising:

a stretchable display panel located at a side of the first plane and supported by the stretchable mechanism.

3. The retractable apparatus according to claim 1, wherein for one connecting portion of the plurality of connecting portions and one of the plurality of connecting rods that are connected to each other, one of the connecting rod and the connecting portion comprises at least one chute, and the other one of the connecting rod and the connecting portion comprises a part located in one chute of the at least one chute and slidable along an extension direction of the chute; and wherein the extension direction of the chute is a retractable direction between the two adjacent connecting portions.

4. The retractable apparatus according to claim 3, wherein the plurality of connecting portions comprises at least one first connecting portion and at least one second connecting portion; the plurality of connecting rods comprises at least one first connecting rod; and one of the at least one first connecting portion and one of the at least one second connecting portion are connected to each other in a retractable manner in a first direction through the first connecting rod.

5. The retractable apparatus according to claim 4, wherein the plurality of connecting portions comprises at least one third connecting portion; the plurality of connecting rods comprises at least one second connecting rod; one of the at least one third connecting portion and one of the at least one second connecting portion are connected to each other in a retractable manner in a second direction through the second connecting rod; and the second direction and the first direction intersect.

6. The retractable apparatus according to claim 5, wherein a retractable state between the one of the at least one second connecting portion and the one of the at least one third connecting portion is not linked to a retractable state between the one of the at least one second connecting portion and the one of the at least one first connecting portion.

7. The retractable apparatus according to claim 5, wherein an extension direction of the one of the at least one first connecting rod is different from an extension direction of the one of the at least one second connecting rod; and a retractable state between the one of the at least one second connecting portion and the one of the at least one third connecting portion is linked to a retractable state between the one of the at least one second connecting portion and the one of the at least one first connecting portion.

8. The retractable apparatus according to claim 7, wherein stretching between the one of the at least one second connecting portion and the one of the at least one second connecting rod drives stretching between the one of the at least one second connecting portion and the one of the at least one first connecting rod; and/or contraction between the one of the at least one second connecting portion and the one of the at least one second connecting rod drives contraction between the one of the at least one second connecting portion and the one of the at least one first connecting rod.

9. The retractable apparatus according to claim 8, wherein each of the plurality of connecting portions comprises:

at least one transmission rod pair, wherein each of the at least one transmission rod pair comprises two transmission rods extending in different directions and hinged to each other, and each of the two transmission rods comprises a first end and a second end; and at least one rotationally connecting member, wherein each of the at least one rotationally connecting member is configured to achieve mutual rotation between structures with respect to an axial direction perpendicular to the first plane, and the at least one rotationally connecting member comprises at least one first rotationally connecting member; and wherein the first ends of the two transmission rods are rotationally connected to each other through one of the at least one first rotationally connecting member in such a manner that the two transmission rods are capable of rotating relative to each other with respect to an axial direction perpendicular to the first plane, and the second ends of the two transmission rods are connected to two different connecting rods of the plurality of connecting rods, respectively.

10. The retractable apparatus according to claim 9, wherein each of the plurality of connecting portions comprises the at least one chute, and the at least one chute comprises at least one first chute, at least one second chute, and at least one third chute; the at least one rotationally connecting member comprises at least one second rotationally connecting member and at least one third rotationally connecting member; and each of the at least one first rotationally connecting member is limited in one of the at least one third chute and configured to drive the first ends of the two transmission rods to slide along the third chute;

the second end of one of the two transmission rods is connected to one of the at least one first connecting rod through one of the at least one second rotationally connecting member, and the one of the at least one second rotationally connecting member is limited in one of the at least one first chute and configured to drive the second end of the one of the two transmission rods to slide along the one of the at least one first chute; and the second end of the other one of the two transmission rods is connected to one of the at least one second connecting rod through one of the at least one third rotationally connecting member, and one of the at least one third rotationally connecting member is limited in one of the at least one second chute and configured to drive the second end of the other one of the two transmission rods to slide along the one of the at least one second chute.

11. The retractable apparatus according to claim 10, wherein each of the at least one first chute extends along the first direction, each of the at least one second chute extends along the second direction, each of the at least one third chute extends along a third direction, and the third direction is intersected with each of the first direction and the second direction; and one third chute of the at least one third chute is located between one first chute of the at least one first chute and one second chute of the at least one the second chute, the first chute, the second chute, and the third chute are arranged in a divergent manner, and an extension line of the first chute, an extension line of the second chute, and an extension line of the third chute converge at a central point.

12. The retractable apparatus according to claim 11, wherein the two transmission rods are configured to rotate relative to each other in the first plane to form an angle $\theta$ close to the central point, where $0° < \theta < 180°$.

13. The retractable apparatus according to claim 12, wherein for one of the at least one second connecting portion, one of the at least one second connecting rod is configured to drive the second end of one of the two transmission rods connected thereto to move along one of the at least one second chute and away from the central point in such a manner that the stretching between the second connecting portion and the second connecting rod is achieved; the second end of the one of the two transmission rods is configured to move away from the central point to drive the first end of the one of the two transmission rods and the first end of the other one of the two transmission rods to move along one of the at least one third chute and away from the central point, then drive the second end of the other one of the two transmission rods to move along one of the at least one first chute and away from the central point, and then drive one of the at least one first connecting rod connected to the other one of the two transmission rods to move away from the central point, to realize the stretching between the second connecting portion and the first connecting rod; and/or the one of the at least one second connecting rod is configured to drive the second end of one of the two transmission rods connected thereto to move along one of the at least one second chute and towards the central point in such a manner that the contraction between the second connecting portion and the second connecting rod is achieved; the second end of the one of the two transmission rods is configured to move towards the central point to drive the first end of the one of the two transmission rods and the first end of the other one of the two transmission rods to move along one of the at least one third chute and towards the central point, then drive the second end of the other one of the two transmission rods to move along one of the at least one first chute and towards the central point, and then drive one of the at least one first connecting rod connected to the other one of the two transmission rods to move towards the central point in such a manner that the contraction between the second connecting portion and the first connecting rod is achieved.

14. The retractable apparatus according to claim 12, wherein the at least one transmission rod pair comprises at least three transmission rod pairs;

the second ends of the two transmission rods of a first pair of the at least three transmission rod pairs are respectively connected to the second end of one of the two transmission rods of a second pair of the at least three transmission rod pairs and the second end of one of the two transmission rods of a third pair of the at least three transmission rod pairs through at least two of the at least one rotationally connecting member; and one of the two transmission rods of one pair of the at least three transmission rod pairs and one of the two transmission rods of another pair of the at least three transmission rod pairs are connected to one of the plurality of connecting rods through one of the at least one rotationally connecting member.

15. The retractable apparatus according to claim 14, wherein the at least three connecting portions comprise four transmission rod pairs; and the at least one first chute comprises two first chutes, the at least one second chute comprises two second chutes, and the at least one third chute comprises four third chutes, wherein extension lines of the two first chutes, extension lines of the two second chutes, and extension lines of the four third chutes converge at the central point, one of the two first chutes and one of the two second chutes are spaced apart from each other, and one of the four third chutes is disposed between one of the two first chutes and one of the two second chutes that are adjacent to each other;

one of the at least one rotationally connecting member connects one of the two transmission rods of one pair of the four transmission rod pairs to one of the two transmission rods of another pair of the four transmission rod pairs and is limited in one of the two first chutes;

another one of the at least one rotationally connecting member connects one of the two transmission rods of one of the four transmission rod pairs to one of the two transmission rods of another one of the four transmission rod pairs and is limited in one of the two second chutes; and in the first plane, one of the two transmission rods of one of the four transmission rod pairs and one of the two transmission rods of another one of the four transmission rod pairs are connected to each other, and a side, away from the central point, of the one of the two transmission rods of one pair of the four transmission rod pairs, and a side, away from the central point, of the one of the two transmission rods of another one of the four transmission rod pairs form an angle $\alpha$, where $180° \geq \alpha > 90°$.

16. The retractable apparatus according to claim 15, wherein in the first plane, an angle formed between one first chute of the two first chutes and one of the four third chutes that is adjacent to the first chute is $\gamma 1$, and an angle formed between one second chute of the two second chutes and one of the four third chutes that is adjacent to the second chute is $\gamma 2$, where $|\gamma 1 - \gamma 2| \leq 10°$.

17. The retractable apparatus according to claim 10, wherein each of the at least one first chute extends along the first direction, and each of the at least one second chute and the at least one third chute extends along the second direction; and the at least one second chute and the at least one third chute are arranged in the second direction, and one of the at least one first chute is located at a same side of one of the at least one second chute and one of the at least one third chute.

18. The retractable apparatus according to claim 17, wherein for one of the at least one second connecting portion, one of the at least one second connecting rod is configured to drive the second end of one of the two transmission rods connected thereto to move along one of the at least one second chute and away from one of the at least one third chute in such a manner that the stretching between the second connecting portion and the second connecting rod is achieved; the second end of the one of the two transmission rods is configured to move away from the one of the at least one third chute to drive the first end of the one of the two transmission rods and the first end of the other one of the two transmission rods to move along one of the at least one third chute and towards to one of the at least one second chute, and then drive the second end of the other one of the two transmission rods to move along one of the at least one first chute and away from one of the at least one third chute in such a manner that the stretching between the second connecting portion and the first connecting rod is achieved; and/or the one of the at least one second connecting rod is configured to drive the second end of one of the two transmission rods connected thereto to move along the second chute and towards one of the at least one third chute in such a manner that the contraction between the second connecting portion and the second connecting rod is achieved; the second end of one of the two transmission rods is configured to move towards one of the at least one third chute to drive the first end of one of the two transmission rods and the first end of the other one of the two transmission rods to move along one of the at least one third chute and away from one of the at least one second chute, and then drive the second end of the other one of the two transmission rods to move along one of the at least one first chute and towards one of the at least one third chute in such a manner that the contraction between the second connecting portion and the first connecting rod is achieved.

19. The retractable apparatus according to claim 17, wherein the at least one transmission rod pair comprises at least two transmission rod pairs, and in the first plane, two transmission rod pairs of the at least two transmission rod pairs are disposed in reverse symmetry with respect to an axis, and the axis is a central symmetry line between one of the at least one third chute and one of the at least one second chute;

the at least one first chute comprises two first chutes, the at least one second chute comprises two second chutes, and the at least one third chute comprises two third chutes; and the two first chutes are respectively located at two sides of each of the two second chutes in the second direction and located at two sides of each of the two third chutes in the second direction; and one of the two second chutes cooperating with one pair of the two transmission rod pairs and one of the two third chutes cooperating with another pair of the at least two transmission rod pairs are located at a same side of one of the two first chutes.

20. The retractable apparatus according to claim 19, wherein each of the plurality of connecting portions further comprises at least one auxiliary rod; and each of the at least one auxiliary rod comprises a first end connected to the first ends of the two transmission rods of one pair of the at least two transmission rod pairs through one of the at least one first rotationally connecting member, and a second end connected, through one of the at least one rotationally connecting member, to the second end of one of the two transmission rods of another pair of the at least two transmission rod pairs that is connected to one of the at least one first connecting rod.

* * * * *